US008995899B2

(12) United States Patent
Hasegawa et al.

(10) Patent No.: US 8,995,899 B2
(45) Date of Patent: Mar. 31, 2015

(54) PROTECTING AGENT-SUPPLYING DEVICE, PROCESS CARTRIDGE, IMAGE FORMING APPARATUS

(75) Inventors: Kunio Hasegawa, Kanagawa (JP); Hiroshi Nakai, Kanagawa (JP); Shinya Tanaka, Kanagawa (JP); Kohsuke Yamamoto, Kanagawa (JP); Taichi Urayama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 338 days.

(21) Appl. No.: 13/137,717

(22) Filed: Sep. 7, 2011

(65) Prior Publication Data

US 2012/0057912 A1 Mar. 8, 2012

(30) Foreign Application Priority Data

Sep. 8, 2010 (JP) ..... 2010-201140

(51) Int. Cl.
*G03G 21/00* (2006.01)

(52) U.S. Cl.
CPC ..... *G03G 21/0094* (2013.01)
USPC ..... 399/346; 399/353; 430/119.85

(58) Field of Classification Search
USPC ..... 399/346; 430/119.85
See application file for complete search history.

(56) References Cited

U.S. PATENT DOCUMENTS

| | | | | |
|---|---|---|---|---|
| 3,501,294 | A | 3/1970 | Joseph | |
| 5,870,650 | A * | 2/1999 | Takahashi et al. | 399/98 |
| 6,035,157 | A * | 3/2000 | Takahashi et al. | 399/98 |
| 6,060,205 | A * | 5/2000 | Takeichi et al. | 430/126.2 |
| 7,209,699 | B2 * | 4/2007 | Yamaguchi et al. | 399/346 |
| 7,706,735 | B2 * | 4/2010 | Kishi | 399/346 |
| 7,933,546 | B2 * | 4/2011 | Fukao et al. | 399/346 |
| 8,036,585 | B2 * | 10/2011 | Okamoto | 399/346 |
| 8,351,838 | B2 * | 1/2013 | Urayama et al. | 399/346 |
| 8,649,722 | B2 * | 2/2014 | Urayama et al. | 399/346 |
| 8,649,723 | B2 * | 2/2014 | Hasegawa et al. | 399/346 |

(Continued)

FOREIGN PATENT DOCUMENTS

| | | | |
|---|---|---|---|
| JP | 51022380 | B | 7/1976 |
| JP | 2002268397 | A | 9/2002 |

(Continued)

OTHER PUBLICATIONS

Japanese Office Action dated Apr. 8, 2014 for corresponding Japanese Application No. 2010-201140.

*Primary Examiner* — David Gray
*Assistant Examiner* — Geoffrey Evans
(74) *Attorney, Agent, or Firm* — Harness, Dickey & Pierce P.L.C.

(57) ABSTRACT

A protecting agent-supplying device including: a rotation member configured to rotate in a certain direction; an image bearing member-protecting agent containing a fatty acid metal salt and an inorganic lubricant, and being in the form of a solid, wherein the agent is scraped off by the rotation of the rotation member, supplied to an image bearing member for protection thereof, and disposed to have a surface facing the rotation member, which surface has a width G in a direction along the certain direction, and wherein the position X (a center of the width G) is located upstream in the direction along the certain direction from the position Y (a line of intersection between the surface facing and a line extended from the rotational center of the rotation member perpendicular to the surface facing), and a distance d between these positions satisfies a formula $0<d\leq G/2$.

18 Claims, 8 Drawing Sheets

(56) References Cited

U.S. PATENT DOCUMENTS

| | | | | |
|---|---|---|---|---|
| 8,676,108 | B2 * | 3/2014 | Hasegawa et al. | 399/346 |
| 2005/0191099 | A1 * | 9/2005 | Yamaguchi et al. | 399/346 |
| 2006/0285897 | A1 * | 12/2006 | Sugiura et al. | 399/346 |
| 2007/0166087 | A1 * | 7/2007 | Yamaguchi et al. | 399/346 |
| 2008/0220355 | A1 * | 9/2008 | Kamoi et al. | 430/66 |
| 2009/0028618 | A1 * | 1/2009 | Kabata et al. | 399/346 |
| 2009/0060600 | A1 * | 3/2009 | Ninomiya et al. | 399/346 |
| 2009/0169236 | A1 * | 7/2009 | Fukao et al. | 399/99 |
| 2009/0196665 | A1 | 8/2009 | Tanaka et al. | |
| 2009/0285613 | A1 | 11/2009 | Nakai et al. | |
| 2009/0290919 | A1 | 11/2009 | Tanaka et al. | |
| 2009/0311014 | A1 | 12/2009 | Tanaka et al. | |
| 2010/0034560 | A1 | 2/2010 | Tanaka et al. | |
| 2010/0034570 | A1 | 2/2010 | Hatakeyama et al. | |
| 2010/0054829 | A1 | 3/2010 | Iio et al. | |
| 2010/0061779 | A1 * | 3/2010 | Okamoto | 399/346 |
| 2010/0183972 | A1 | 7/2010 | Hasegawa et al. | |
| 2010/0209143 | A1 | 8/2010 | Nakai et al. | |
| 2010/0239309 | A1 | 9/2010 | Tanaka et al. | |
| 2010/0310291 | A1 | 12/2010 | Tanaka et al. | |
| 2011/0008088 | A1 | 1/2011 | Nakai et al. | |
| 2011/0038656 | A1 | 2/2011 | Hasegawa et al. | |
| 2011/0052286 | A1 | 3/2011 | Urayama et al. | |
| 2012/0063825 | A1 * | 3/2012 | Hasegawa et al. | 399/346 |
| 2012/0195662 | A1 * | 8/2012 | Hasegawa et al. | 399/346 |
| 2013/0177329 | A1 * | 7/2013 | Tanaka et al. | 399/66 |
| 2013/0259552 | A1 * | 10/2013 | Hasegawa et al. | 399/346 |
| 2014/0030644 | A1 * | 1/2014 | Hasegawa et al. | 430/56 |
| 2014/0093294 | A1 * | 4/2014 | Komito et al. | 399/346 |
| 2014/0161501 | A1 * | 6/2014 | Watanabe et al. | 399/346 |

FOREIGN PATENT DOCUMENTS

| | | | |
|---|---|---|---|
| JP | 2006350240 | A | 12/2006 |
| JP | 2007-293240 | A | 11/2007 |
| JP | 2008-139798 | A | 6/2008 |
| JP | 2009-151263 | A | 7/2009 |
| JP | 2010-061126 | A | 3/2010 |

* cited by examiner

PROTECTING AGENT-SUPPLYING DEVICE, PROCESS CARTRIDGE, IMAGE FORMING APPARATUS

BACKGROUND OF THE INVENTION

1. Field of the Invention

The present invention relates to a protecting agent-supplying device which supplies an image bearing member-protecting agent to an image bearing member provided in image forming apparatuses such as copiers, facsimiles and printers, a process cartridge including the protecting agent-supplying device, an image forming apparatus including the protecting agent-supplying device.

2. Description of the Related Art

In image forming apparatuses (e.g., copiers, facsimiles and printers) having an image bearing member (e.g., a photoconductor made of, for example, a photoconductive material, or the like), the image bearing member is rotated and subjected sequentially to a charging step, an exposing step, a developing step, a transfer step and a fixing step, etc. for image formation.

In the charging step, a surface of the image bearing member is charged with a charging member such as a charging roller. In the exposing step, a latent electrostatic image is formed on the surface of the image bearing member whose surface has been charged in the charging step. In the developing step, charged toner particles are made to adhere to the latent electrostatic image on the image bearing member surface, to thereby form a visible image. In the transfer step, the visible image is transferred from the image bearing member onto a recording medium (transfer medium) such as paper. In the fixing step, the visible image transferred onto the recording medium is fixed thereon with, for example, heat, pressure or gaseous solvent. Through these steps, an output image is formed on the recording medium.

The developing method in the developing step is roughly classified, depending on the method of charging toner particles, into a two-component developing method and a one-component developing method. In the two-component developing method, toner particles are stirred/mixed with carrier particles and are frictionally charged. In the one-component developing method, toner particles are charged with no use of carrier particles. The one-component developing method is further classified into a magnetic one-component developing method and a non-magnetic one-component developing method, depending on whether or not the developer bearing member (for bearing toner particles) retains toner particles by a magnetic force.

Of these developing methods, the two-component developing method is often employed in, for example, copiers required for high-speed processing and developing reproducibility, and complex machines employing such copiers, in terms of charging stability of the toner particles, charge rising property, long-term stability of image quality, and other requirements. Meanwhile, the one-component developing method is often employed in the compact printers and facsimiles.

In recent years, color images are generally formed, and thus, demand has increasingly arisen for high image quality and stability of image quality. These requirements are intended to be met not by improving the developing method, but by decreasing the average particle diameter of toner particles and using more spherical toner particles. For example, toners produced with the polymerization method are seen on the market. These toners have advantageous features in that they have less angular portions and a uniform average particle diameter, as compared with toners produced with the pulverizing method. In addition, the polymerized toners contribute to not only improvement of image quality but also saving of production energy.

In the charging step, recently, a charging device having the following structure is used in many cases, because it is advantageous in terms of achieving low ozonization and low electric power: the charging device includes, as a charging member, a charging roller obtained by forming a conductive member into a roller shape, and the charging roller is disposed closely to or in contact with a surface of an image bearing member, and then a voltage is applied to a space between the charging roller and the image bearing member so as to charge the surface of the image bearing member.

In such a charging device, a method of applying charge bias obtained by superimposing a direct-current voltage on an alternating-current voltage is used to uniformly charge a surface of an image bearing member. The image forming apparatus using this method needs a large amount of the alternating-current to obtain a desired charged electric potential, compared to the charging method using direct-current alone, and it is necessary to adjust alternating-current frequency to "n" times or more of a linear velocity of an image bearing member ("n" is an integer of 1 or more). For example, when n is 7, and the linear velocity of an image bearing member is 100 mm/sec, 700 (7×100) Hz or higher of the alternating-current frequency is required. When the alternating-current frequency is adjusted to less than "n" times, jitter of period of the alternating-current frequency occurs in an image having uniform intermediate potential such as a half-tone image. Therefore, when a plurality of the linear velocities of the image bearing members are provided in one image forming apparatus, the alternating-current frequency is adjusted according to each of the linear velocities, to thereby obtain charging ability similar to that obtained by the charging method using direct-current alone.

The image bearing member having undergone the transfer step has, on the surface thereof, residual toner components which have not been transferred onto the recording medium. When charged again in the charging step in this state, the image bearing member is not uniformly charged in many cases. Thus, in general, a cleaning step is additionally provided after the transfer step and before the next charging step. In the cleaning step, the toner components and other foreign matters (e.g., paper dust) remaining on the image bearing member are removed with a cleaning member such as a cleaning blade, and the image bearing member surface is sufficiently cleaned before the charging step.

In recent years, cleaning performance for toner has been remarkably improved in the cleaning steps, and the recently-used small and highly spherical toner particles can be cleaned. Such improved cleaning performance reduces stain of the charging member, and the service life of the charging member is elongated. Moreover, such improved cleaning performance prevents toner particles from running through a cleaning blade, and the cleaning blade is less abraded, to thereby elongate the service life thereof.

The image bearing member receives various physical or electrical stresses in the above steps, and the state thereof changes over time, especially after long-term use. For example, as has been known, the stress caused by the friction in the cleaning step abrades and scratches the image bearing member, and also abrades the cleaning member in the cleaning step. Thus, conventionally, there have been proposed methods of supplying a lubricant or lubricating components and of forming a film on the image bearing member surface using the lubricant or lubricating components, in order to reduce the friction force between the image bearing member and the cleaning member.

For example, some patent literatures disclose techniques of forming a lubricant film on the surface of a photoconductor (image bearing member) by supplying a lubricant as the image bearing member-protecting agent onto the photoconductor surface to elongate the service lives of the photoconductor and the cleaning member (see, for example, Japanese Patent Application Publication (JP-B) No. 51-22380, and Japanese Patent Application Laid-Open (JP-A) Nos. 2007-293240, 2002-268397, and 2006-350240). Using the above techniques, the stress applied to the image bearing member in, for example, the charging step can be easily reduced.

Meanwhile, as the component of the lubricant, a lubricant mainly containing a fatty acid zinc salt (see, for example, JP-B No. 51-22380 and JP-A Nos. 2007-293240, and 2002-268397) and a lubricant formed by incorporating an inorganic lubricant into a fatty acid zinc salt (see, for example, JP-A No. 2006-350240) have been known. The latter lubricant decreases in lubricity to a less extent than in the former lubricant, even when receiving the stress due to discharge in the charging step.

That is, it has been known that the former lubricant promptly loses its lubricity due to discharge performed near an image bearing member in the charging step. As a result, the lubricities of the cleaning blade and the image bearing member are impaired, and the toner particles run through between the cleaning blade and the image bearing member, causing image failure. The toner running through significantly occurs in the case of the recently-used small and highly spherical toner particles. Moreover, since with use of the former lubricant the toner running through frequently occurs, and the cleaning blade is abraded, and the service life of an image forming apparatus may be shortened. By contrast, the latter lubricant does not easily decrease in the lubricity, even when a surface of an image bearing member receives an electrical stress in the charging step. Moreover, the latter lubricant forms coating film over an entire surface of an image bearing member and high lubricity is maintained.

In one known configuration in which a lubricant is supplied to the photoconductor surface, the lubricant is formed into a solid bar shape, and a brush which is a rotation member is rubbed against a solid bar lubricant so that the lubricant is scraped off and supplied to the photoconductor surface (see, for example, JP-A Nos. 2007-293240, 2002-268397 and 2006-350240).

In another known configuration in which a lubricant is supplied to a photoconductor, a solid lubricant is elastically brought into contact with a brush to maintain constant, for a long period of time, the amount of the lubricant supplied to the photoconductor (see, for example, JP-A Nos. 2007-293240 and 2002-268397). Meanwhile, compression molding and melt molding are known as methods of solidifying a lubricant into a bar shape (see, for example, JP-A No. 2006-350240).

It has been known that elements of determining an amount of supplying a lubricant to an image bearing member include presence or absence of a toner adhering to a brush, as well as a change of a brush over time. This is because when the toner adheres to the brush the toner scrapes off a lubricant with the brush. By using the latter lubricant described above, the toner running through does not occur, and the toner does not adhere to the brush. Thus, the amount of supplying the lubricant to the image bearing member only depends on the deterioration of the brush. Then, when the brush deteriorates over time, the consumption of the lubricant decreases, and the image bearing member is not sufficiently protected, causing filming. Thus, in order to sufficiently supply the lubricant to the image bearing member for a long period of time, it is necessary to press the lubricant against the brush at high pressure from the beginning of supplying the lubricant. The pressure applied to the latter lubricant is set to be at least approximately 1.2 times higher than that applied to the former lubricant.

However, in the case where the pressure is increased, when the rotational force of the brush is applied to the solid lubricant during the rotation of the brush, the lubricant is elastically brought into contact with the brush. The solid lubricant inclines toward the rotational direction of the brush, and the brush may be brought into contact with a side surface of the lubricant. In such case, the pressure of the brush is not uniformly applied to the solid lubricant in the longitudinal direction of the solid lubricant, and the lubricant is not uniformly scraped off in the longitudinal direction thereof. As a result, the frictional sliding surface of the lubricant is nonuniformly consumed. Once the lubricant is nonuniformly consumed, it is not corrected, but rather progresses. Thus, a nonuniformly consumed part is consumed faster than the set service life, causing shortening of the service life of an entire image forming apparatus.

In this point, there is a proposal of a technique that with the use of the former lubricant formed into a solid, the lubricant is disposed upstream in the rotation direction of the brush, so as to suppress deterioration of the brush over time, i.e., tilt of brush fur, due to disuse of the fur for a long period of time (JP-A No. 2002-268397).

However, since the above-described technique uses the former lubricant, the former lubricant promptly loses its lubricity due to discharge performed near an image bearing member in the charging step. As a result, the lubricities of the cleaning blade and the image bearing member are impaired, and the toner particles run through a gap between the cleaning blade and the image bearing member, causing image failure. The toner running through significantly occurs in the case of the recently-used small and highly spherical toner particles. Moreover, since with use of the former lubricant the toner running through frequently occurs, a cleaning blade is abraded, and the lubricant is nonuniformly consumed, causing shortening of the service life of an image forming apparatus. Moreover, the technique is not positioned as a countermeasure to the nonuniform consumption of the lubricant. In the technique, there is no specific disclosure of a shift value.

BRIEF SUMMARY OF THE INVENTION

The present invention aims to provide a protecting agent-supplying device, which supplies a solid image bearing member-protecting agent containing a fatty acid metal salt and an inorganic lubricant to an image bearing member provided in an image forming apparatus, such as copier, facsimile, printer, etc. while the protecting agent-supplying device prevents or suppresses the solid image bearing member-protecting agent from being nonuniformly consumed, and a process cartridge and an image forming apparatus, provided with the protecting agent-supplying device.

Means for Solving the Problems is as Follows

<1> A protecting agent-supplying device including: a rotation member configured to rotate in a certain direction; an image bearing member-protecting agent containing a fatty acid metal salt and an inorganic lubricant, and being in the form of a solid, wherein the image bearing member-protecting agent is scraped off by the rotation of the rotation member in the certain direction, and supplied to an image bearing member, so as to protect the image bearing member, wherein the image bearing member-protecting agent is disposed to have a surface facing the rotation member, which surface has a width G in a direction along the certain direction, and wherein a center of the width G on the surface facing in the direction along the certain direction is defined as a position X, and a line of intersection between the surface facing and a line extended from the rotational center of the rotation member perpendicular to the surface facing is defined as a position Y, and the position X is located upstream in the direction along the certain direction from the position Y, and a distance d between the position X and the position Y satisfies the relation represented by a formula $0<d\leq G/2$.

<2> The protecting agent-supplying device according to <1>, wherein the fatty acid metal salt is zinc stearate.

<3> The protecting agent-supplying device according to any one of <1> and <2>, wherein the inorganic lubricant contains at least one selected from the group consisting of boron nitride, mica, talc, kaoline, plate-shaped alumina, sericite, molybdenum disulfide, tungsten disulfide, montmorillonite, calcium fluoride, and graphite.

<4> The protecting agent-supplying device according to any one of <1> to <3>, further includes a layer-forming member configured to level the image bearing member-protecting agent supplied to the image bearing member to form a layer on the image bearing member.

<5> A process cartridge including: the protecting agent-supplying device according to any one of <1> to <4>; and an image bearing member, to which an image bearing member-protecting agent is supplied by the protecting agent-supplying device.

<6> An image forming apparatus including the process cartridge according to <5>.

<7> An image forming apparatus including the protecting agent-supplying device according to any one of <1> to <4>; and an image bearing member, to which an image bearing member-protecting agent is supplied by the protecting agent-supplying device.

<8> The image forming apparatus according to any one of <6> to <7>, further including a cleaning device configured to remove a toner remaining on the image bearing member therefrom, wherein the cleaning device is provided in contact with the image bearing member, and is located, in a moving direction of the image bearing member, downstream of a position where a toner image on the image bearing member is transferred onto a transfer medium and upstream of a position where the image bearing member-protecting agent is supplied to the image bearing member by the protecting agent-supplying device.

<9> The image forming apparatus according to any one of <6> to <8>, wherein the image bearing member has a layer containing a thermosetting resin as the outermost surface thereof.

<10> The image forming apparatus according to any one of <6> to <9>, wherein the image bearing member is a photoconductor.

<11> The image forming apparatus according to any one of <6> to <9>, wherein the image bearing member is an intermediate transfer medium.

<12> The image forming apparatus according to any one of <6> to <11>, further including a charging unit which is provided so as to face the image bearing member and configured to charge the image bearing member.

<13> The image forming apparatus according to <12>, wherein the charging unit includes a voltage-applying unit configured to apply a voltage containing an alternating-current component.

<14> The image forming apparatus according to any one of <6> to <13>, wherein a toner having an average circularity of 0.93 to 1.00 is used.

<15> The image forming apparatus according to any one of <6> to <14>, wherein a toner having a ratio (D4/Dn) of a mass average particle diameter D4 to a number average particle diameter Dn of 1.00 to 1.40 is used.

<16> An image forming method including forming an image using the protecting agent-supplying device according to any one of <1> to <4>, the process cartridge according to <5>, and the image forming apparatus according to any one of <6> to <15>.

Since a protecting agent-supplying device of the present invention includes a rotation member configured to rotate in a certain direction; an image bearing member-protecting agent containing a fatty acid metal salt and an inorganic lubricant, and being in the form of a solid, wherein the image bearing member-protecting agent is scraped off by the rotation of the rotation member in the certain direction, and supplied to an image bearing member, so as to protect the image bearing member, wherein the image bearing member-protecting agent is disposed to have a surface facing the rotation member, which surface has a width G in a direction along the certain direction, and wherein a center of the width G on the surface facing in the direction along the certain direction is defined as a position X, and a line of intersection between the surface facing and a line extended from the rotational center of the rotation member perpendicular to the surface facing is defined as a position Y, and the position X is located upstream in the direction along the certain direction from the position Y, and a distance d between the position X and the position Y satisfies the relation represented by a formula $0<d\leq G/2$, the solid image bearing member-protecting agent containing the fatty acid metal salt and the inorganic lubricant is prevented from being nonuniformly consumed, and is elongated in service life. In addition, the image bearing member-protecting agent can be consistently supplied in a sufficient amount to the image bearing member for a long period of time, and the image bearing member can be suitably cleaned. Thus, the image bearing member can be prevented from deterioration due to abrasion and from being stained due to filming. Also, when a charging unit is disposed so as to face the image bearing member, the charging unit can be prevented from being stained. Thus, the protecting agent-supplying device can contribute to elongation of the service lives of the image bearing member and other members, and also to favorable image formation.

Since the fatty acid metal salt is zinc stearate according to the present invention, the solid image bearing member-protecting agent containing the fatty acid metal salt and the inorganic lubricant is prevented from being nonuniformly consumed, and is elongated in service life. In addition, the image bearing member-protecting agent can be consistently supplied in a sufficient amount to the image bearing member for a long period of time, and the image bearing member can be suitably cleaned using, as the fatty acid metal salt, zinc stearate which is inexpensive, excellent in hydrophobicity, very stable and has suitable image bearing member protective properties. Thus, the image bearing member can be prevented from deterioration due to abrasion and from being stained due to filming. Also, when a charging unit is disposed so as to face the image bearing member, the charging unit can be prevented from being stained. Thus, the protecting agent-supplying device can contribute to elongation of the service lives of the image bearing member and other members, and also to favorable image formation.

Since the inorganic lubricant contains at least one selected from the group consisting of boron nitride, mica, talc, kaoline, plate-shaped alumina, sericite, molybdenum disulfide, tungsten disulfide, montmorillonite, calcium fluoride, and graphite, according to the present invention, the solid image bearing member-protecting agent containing the fatty acid metal salt and the inorganic lubricant is prevented from being nonuniformly consumed, and is elongated in service life. In addition, the image bearing member-protecting agent can be consistently supplied in a sufficient amount to the image bearing member for a long period of time, and the image bearing member can be suitably cleaned. Thus, the image bearing member can be prevented from deterioration due to abrasion and from being stained due to filming. Also, when a charging unit is disposed so as to face the image bearing member, the charging unit can be prevented from being stained. Thus, the protecting agent-supplying device can contribute to elongation of the service lives of the image bearing member and other members, and also to favorable image formation.

Since the protecting agent-supplying device of the present invention further includes a layer-forming member configured to level the image bearing member-protecting agent supplied to the image bearing member to form a layer on the image bearing member, the image bearing member-protecting agent can effectively protect the image bearing member. Also, when the image bearing member is exposed to light, the image bearing member-protecting agent can suppress inhibition by exposure. Also, the solid image bearing member-protecting agent containing the fatty acid metal salt and the inorganic lubricant is prevented from being nonuniformly consumed, and is elongated in service life. In addition, the image bearing member-protecting agent can be consistently supplied in a sufficient amount to the image bearing member for a long period of time, and the image bearing member can be suitably cleaned. Thus, the image bearing member can be prevented from deterioration due to abrasion and from being stained due to filming. Also, when a charging unit is disposed so as to face the image bearing member, the charging unit can be prevented from being stained. Thus, the protecting agent-supplying device can contribute to elongation of the service lives of the image bearing member and other members, and also to favorable image formation.

Since the process cartridge of the present invention includes the above-described protecting agent-supplying device and an image bearing member, to which the image bearing member-protecting agent is supplied by the protecting agent-supplying device, the solid image bearing member-protecting agent containing the fatty acid metal salt and the inorganic lubricant is prevented from being nonuniformly consumed, and is elongated in service life. In addition, the image bearing member-protecting agent can be consistently supplied in a sufficient amount to the image bearing member for a long period of time, and the image bearing member can be suitably cleaned. Thus, the image bearing member can be prevented from deterioration due to abrasion and from being stained due to filming. Also, when a charging unit is disposed so as to face the image bearing member, the charging unit can be prevented from being stained. Thus, the process cartridge can contribute to elongation of the service lives of the image bearing member and other members, and also to favorable image formation. Furthermore, the process cartridge can be elongated in service life before replacement, and the constituent parts (e.g., the image bearing member) can be recycled to attain waste reduction.

Since the image forming apparatus of the present invention includes the above-described process cartridge, the solid image bearing member-protecting agent containing the fatty acid metal salt and the inorganic lubricant is prevented from being nonuniformly consumed, and is elongated in service life. In addition, the image bearing member-protecting agent can be consistently supplied in a sufficient amount to the image bearing member for a long period of time, and the image bearing member can be suitably cleaned. Thus, the image bearing member can be prevented from deterioration due to abrasion and from being stained due to filming. Also, when a charging unit is disposed so as to face the image bearing member, the charging unit can be prevented from being stained. Thus, the image forming apparatus can contribute to elongation of the service lives of the image bearing member and other members, and also to favorable image formation. Furthermore, the process cartridge can be elongated in service life before replacement to reduce running cost, and the constituent parts (e.g., the image bearing member) can be recycled to attain waste reduction.

Since the image forming apparatus of the present invention includes the above-described protecting agent-supplying device and an image bearing member to which the image bearing member-protecting agent is supplied by the protecting agent-supplying device, the solid image bearing member-protecting agent containing the fatty acid metal salt and the inorganic lubricant is prevented from being nonuniformly consumed, and is elongated in service life. In addition, the image bearing member-protecting agent can be consistently supplied in a sufficient amount to the image bearing member for a long period of time, and the image bearing member can be suitably cleaned. Thus, the image bearing member can be prevented from deterioration due to abrasion and from being stained due to filming. Also, when a charging unit is disposed so as to face the image bearing member, the charging unit can be prevented from being stained. Thus, the image forming apparatus can contribute to elongation of the service lives of the image bearing member and other members, and also to favorable image formation for a long period of time. Furthermore, the image bearing member can be elongated in service life before replacement to reduce running cost, and the constituent parts (e.g., the image bearing member) can be recycled to attain waste reduction.

Since the image forming apparatus of the present invention further includes a cleaning device configured to remove a toner remaining on the image bearing member therefrom, wherein the cleaning device is provided in contact with the image bearing member, and is located, in a moving direction of the image bearing member, downstream of a position where a toner image on the image bearing member is transferred onto a transfer medium and upstream of a position where the image bearing member-protecting agent is supplied to the image bearing member by the protecting agent-supplying device, the solid image bearing member-protecting agent containing the fatty acid metal salt and the inorganic lubricant is prevented from being nonuniformly consumed, and is elongated in service life. In addition, the image bearing member-protecting agent can be consistently supplied in a sufficient amount to the image bearing member for a long period of time, and the image bearing member can be suitably cleaned. Moreover, the image bearing member-protecting agent can be applied to the image bearing member having undergone cleaning by the cleaning device, and thus, the image bearing member can be effectively protected by the image bearing member-protecting agent. The image bearing member can be prevented from deterioration due to abrasion and from being stained due to filming. Also, when a charging unit is disposed so as to face the image bearing member, the charging unit can be prevented from being stained. Thus, the image forming apparatus can contribute to elongation of the service lives of the image bearing member and other members, and also to favorable image formation for a long period of time. Furthermore, the image bearing member can be elongated in service life before replacement to reduce running cost, and the constituent parts (e.g., the image bearing member) can be recycled to attain waste reduction.

Since the image bearing member has a layer containing a thermosetting resin as the outermost surface thereof according to the present invention, the solid image bearing member-protecting agent containing the fatty acid metal salt and the inorganic lubricant is prevented from being nonuniformly consumed, and is elongated in service life. In addition, the image bearing member-protecting agent can be consistently supplied in a sufficient amount to the image bearing member for a long period of time, and the image bearing member can be suitably cleaned. Thus, the image bearing member can be prevented from deterioration due to abrasion and from being stained due to filming. Also, when a charging unit is disposed so as to face the image bearing member, the charging unit can be prevented from being stained. Thus, the image forming apparatus can contribute to elongation of the service lives of the image bearing member and other members, for example, the service life of the image bearing member, which has a layer containing a thermosetting resin as at least the outermost surface thereof, can be elongated to such an extent that requires substantially no replacement, and also contribute to favorable image formation for a long period of time. Furthermore, the image bearing member can be elongated in service life before replacement to reduce running cost, and the constituent parts (e.g., the image bearing member) can be recycled to attain waste reduction.

Since the image bearing member is a photoconductor according to the present invention, the solid image bearing member-protecting agent containing the fatty acid metal salt and the inorganic lubricant is prevented from being nonuniformly consumed, and is elongated in service life. In addition, the image bearing member-protecting agent can be consistently supplied in a sufficient amount to the photoconductor for a long period of time, and the photoconductor can be suitably cleaned. Thus, the photoconductor can be prevented from deterioration due to abrasion and from being stained due to filming, and the charging unit can be prevented from being stained. Thus, the image forming apparatus can contribute to elongation of the service lives of the photoconductor and the charging unit, and also to favorable image formation for a long period of time. Furthermore, the photoconductor and the charging unit can be elongated in service lives before replacement to reduce running cost, and the constituent parts (e.g., the photoconductor and the charging unit) can be recycled to attain waste reduction.

Since the image bearing member is an intermediate transfer medium according to the present invention, the solid image bearing member-protecting agent containing the fatty acid metal salt and the inorganic lubricant is prevented from being nonuniformly consumed, and is elongated in service life. In addition, the image bearing member-protecting agent can be consistently supplied in a sufficient amount to the intermediate transfer medium for a long period of time, and the intermediate transfer medium can be suitably cleaned. Thus, the intermediate transfer medium can be prevented from deterioration due to abrasion and from being stained due to filming. Also, when a charging unit is disposed so as to face the intermediate transfer medium, the charging unit can be prevented from being stained. Thus, the image forming apparatus can contribute to elongation of the service lives of the intermediate transfer medium and other members, and also to favorable image formation for a long period of time. Furthermore, the intermediate transfer medium can be elongated in service life before replacement to reduce running cost, and the constituent parts (e.g., the intermediate transfer medium) can be recycled to attain waste reduction.

Since the above-described image forming apparatus further includes a charging unit which is provided so as to face the image bearing member and configured to charge the image bearing member, the solid image bearing member-protecting agent containing the fatty acid metal salt and the inorganic lubricant is prevented from being nonuniformly consumed, and is elongated in service life. In addition, the image bearing member-protecting agent can be consistently supplied in a sufficient amount to the image bearing member for a long period of time, and the image bearing member can be suitably cleaned. Thus, the image bearing member can be prevented from deterioration due to abrasion and from being stained due to filming, and the charging unit can be prevented from being stained and also from giving electrical stress to the image bearing member. Thus, the image forming apparatus can contribute to elongation of the service lives of the image bearing member and charging unit, and also to favorable image formation for a long period of time. Furthermore, the image bearing member and the charging unit can be elongated in service life before replacement to reduce running cost, and the constituent parts of the charging unit can be recycled to attain waste reduction.

Since the above-described charging unit includes a voltage-applying unit configured to apply a voltage containing an alternating-current component, the solid image bearing member-protecting agent containing the fatty acid metal salt and the inorganic lubricant is prevented from being nonuniformly consumed, and is elongated in service life. In addition, the image bearing member-protecting agent can be consistently supplied in a sufficient amount to the image bearing member for a long period of time, and the image bearing member can be suitably cleaned. Thus, the image bearing member can be prevented from deterioration due to abrasion and from being stained due to filming, and the charging unit can be prevented from being stained and also from giving high electrical stress (caused by a voltage containing an alternating-current component derived from the charging unit) to the image bearing member. Thus, the image forming apparatus can contribute to elongation of the service lives of the image bearing member and charging unit, and also to favorable image formation. Furthermore, the image bearing member and the charging unit can be elongated in service life before replacement to reduce running cost, and the constituent parts of the charging unit can be recycled to attain waste reduction.

Since in the above-described image forming apparatus, a toner having an average circularity of 0.93 to 1.00 is used, the solid image bearing member-protecting agent containing the fatty acid metal salt and the inorganic lubricant is prevented from being nonuniformly consumed, and is elongated in service life. In addition, the image bearing member-protecting agent can be consistently supplied in a sufficient amount to the image bearing member for a long period of time, and the image bearing member can be suitably cleaned since a toner having high circularity can be suitably cleaned. Thus, the image bearing member can be prevented from deterioration due to abrasion and from being stained due to filming. Also, when a charging unit is disposed so as to face the image bearing member, the charging unit can be prevented from being stained. Thus, the image forming apparatus can contribute to elongation of the service lives of the image bearing member and other members, and also to favorable image formation for a long period of time. Furthermore, the image bearing member can be elongated in service life before replacement to reduce running cost, and the constituent parts (e.g., the image bearing member) can be recycled to attain waste reduction.

Since in the above-described image forming apparatus, a toner having a ratio (D4/Dn) of a mass average particle diameter D4 to a number average particle diameter Dn of 1.00 to 1.40 is used, the solid image bearing member-protecting agent containing the fatty acid metal salt and the inorganic lubricant is prevented from being nonuniformly consumed, and is elongated in service life. In addition, the image bearing member-protecting agent can be consistently supplied in a sufficient amount to the image bearing member for a long period of time, and the image bearing member can be suitably cleaned since a toner having particles uniform in diameter can be suitably cleaned. Thus, the image bearing member can be prevented from deterioration due to abrasion and from being stained due to filming. Also, when a charging unit is disposed so as to face the image bearing member, the charging unit can be prevented from being stained. Thus, the image forming apparatus can contribute to elongation of the service lives of the image bearing member and other members, and also to favorable image formation for a long period of time. Furthermore, the image bearing member and other members can be elongated in service lives before replacement to reduce running cost, and the constituent parts (e.g., the image bearing member) can be recycled to attain waste reduction.

Since an image forming method uses the above-described protecting agent-supplying device, the above-described process cartridge, and/or the above-described image forming apparatus of the present invention, the solid image bearing member-protecting agent containing the fatty acid metal salt and the inorganic lubricant is prevented from being nonuniformly consumed, and is elongated in service life. In addition, the image bearing member-protecting agent can be consistently supplied in a sufficient amount to the image bearing member for a long period of time, and the image bearing member can be suitably cleaned. Thus, the image bearing member can be prevented from deterioration due to abrasion and from being stained due to filming. Also, when a charging unit is disposed so as to face the image bearing member, the charging unit can be prevented from being stained. Thus, the image forming method can contribute to elongation of the service lives of the image bearing member and other members, and also to favorable image formation for a long period of time. Furthermore, the image bearing method to allow the image bearing member and other members to be elongated in service lives before replacement to reduce running cost, and the constituent parts (e.g., the image bearing member) can be recycled to attain waste reduction.

DETAILED DESCRIPTION OF THE INVENTION (Protecting Agent-Supplying Device)

A protecting agent-supplying device including: a rotation member configured to rotate in a certain direction; an image bearing member-protecting agent containing a fatty acid metal salt and an inorganic lubricant, and being in the form of a solid, wherein the image bearing member-protecting agent is scraped off by the rotation of the rotation member in the certain direction, and supplied to an image bearing member, so as to protect the image bearing member, wherein the image bearing member-protecting agent is disposed to have a surface facing the rotation member, which surface has a width G in a direction along the certain direction, and wherein a center of the width G on the surface facing in the direction along the certain direction is defined as a position X, and a line of intersection between the surface facing and a line extended from the rotational center of the rotation member perpendicular to the surface facing is defined as a position Y, and the position X is located upstream in the direction along the certain direction from the position Y, and a distance d between the position X and the position Y satisfies the relation represented by a formula $0<d\leq G/2$.

Figure 1:
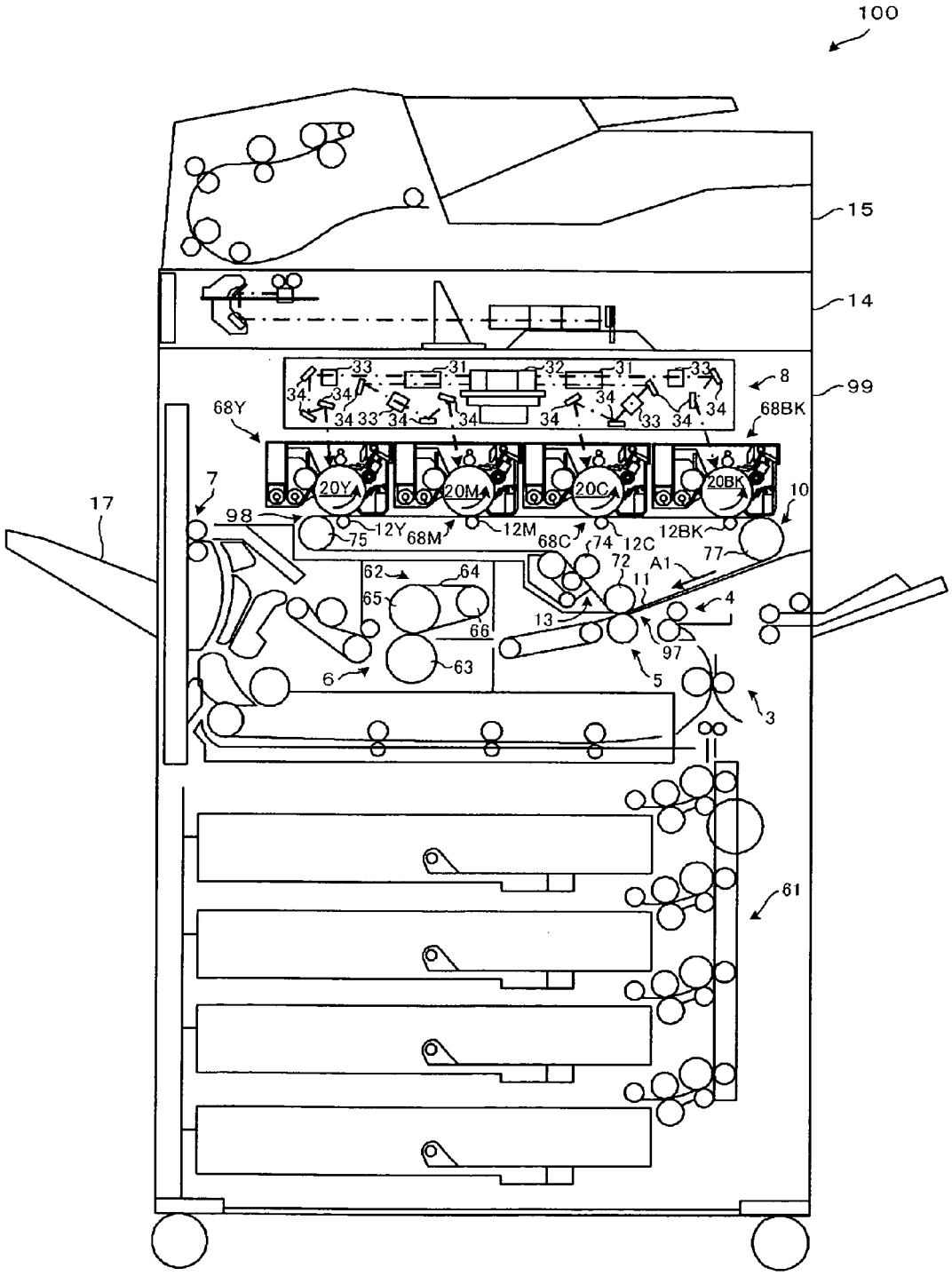
FIG. 1 is a schematic elevational view of an image forming apparatus to which the present invention is applied.

FIG. 1 schematically shows an image forming apparatus to which the present invention is applied. An image forming apparatus 100 is a complex machine of a color laser copier and a printer, but may be other image forming apparatuses such as other types of copiers, facsimiles, printers and complex machines thereof. The image forming apparatus 100 performs image forming processing on the basis of image signals corresponding to image data of an original document read by the image forming apparatus 100, or to image information received from the outside of the image forming apparatus 100. The image forming apparatus 100 can perform image formation on recording media (recording sheets) such as heavy paper (e.g., OHP sheets, cards and postcards) and mailing envelopes as well as plain paper commonly used for copying, etc.

The image forming apparatus 100 employs a so-called tandem method based on a tandem structure, in which photoconductor drums (latent image bearing members) 20Y, 20M, 20C and 20BK are arranged in parallel. These photoconductor drums 20Y, 20M, 20C and 20BK are image bearing members which are able to form images of colors respectively corresponding to yellow, magenta, cyan and black.

The photoconductor drums 20Y, 20M, 20C and 20BK, in which the surfaces of these members are moved, are rotatably supported in a frame (not shown) of a main body 99 of the image forming apparatus 100, and arranged in this order along the direction indicated by arrow A1 from the upstream side thereof; i.e., the direction in which a transfer belt 11 serving as a transfer medium which is an image bearing member is moved. The characters Y, M, C and BK after the reference numbers indicate the members, respectively, for yellow, magenta, cyan and black.

Figure 2:
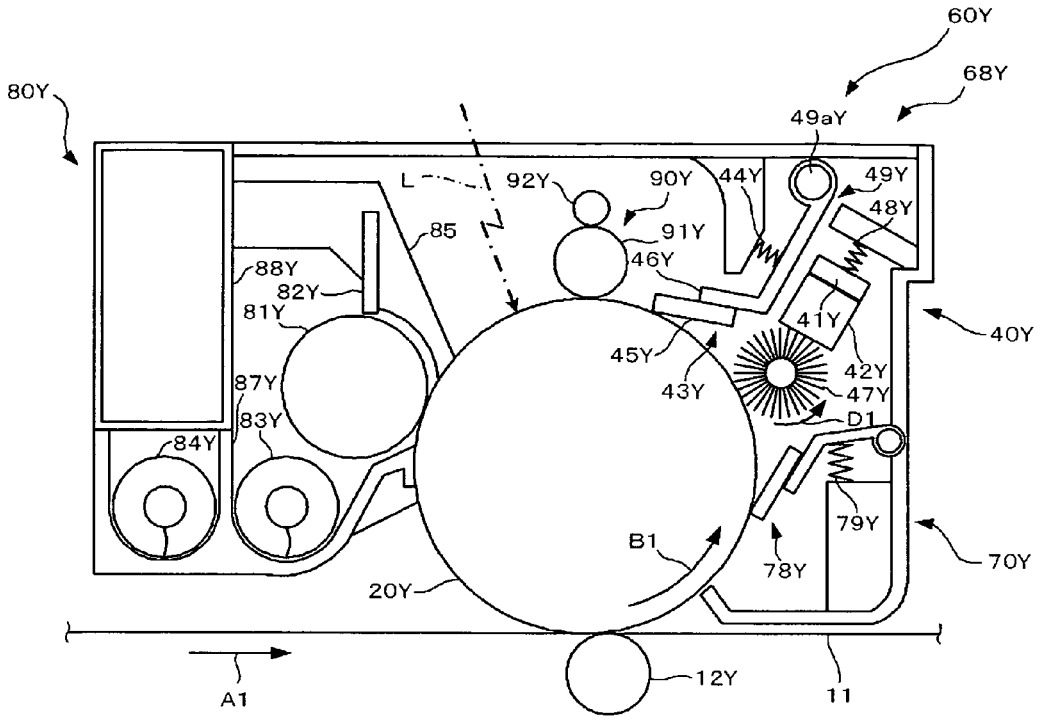
FIG. 2 is a schematic elevational view showing a configuration of a protecting agent-supplying device containing an image bearing member-protecting agent, etc. provided around one of the image bearing members provided in the image forming apparatus shown in FIG. 1.

The photoconductor drums 20Y, 20M, 20C and 20BK are contained respectively in image forming units 60Y, 60M, 60C and 60BK as shown in FIG. 2 for forming images of yellow (Y), magenta (M), cyan (C) and black (BK).

As shown in FIG. 1, the photoconductor drums 20Y, 20M, 20C and 20BK are located at the outer surface (i.e., at the side where images are to be formed) of the transfer belt 11 which is an intermediate transfer medium. The intermediate transfer medium is an endless belt which is provided slightly above the center portion of the main body 99.

The transfer belt 11 can be moved along the direction indicated by arrow A1 with facing the photoconductor drums 20Y, 20M, 20C and 20BK. The visible images (toner images) formed on the photoconductor drums 20Y, 20M, 20C and 20BK are transferred in a superimposed manner onto the transfer belt 11 moving along the direction A1. After that, the composite image is transferred at one time onto recording paper serving as a transfer medium or a recording medium (not shown).

The transfer belt 11 faces the photoconductor drums 20Y, 20M, 20C and 20BK at the upper side, and primary transfer portion 98 are formed between the transfer belt 11 and the photoconductor drums 20Y, 20M, 20C and 20BK. In the primary transfer portion 98 toner images on the photoconductor drums 20Y, 20M, 20C and 20BK are transferred onto the transfer belt 11.

The toner images formed on the photoconductor drums 20Y, 20M, 20C and 20BK are transferred and superimposed on the same position of the transfer belt 11, with the transfer belt 11 is being moved in the direction A1. Specifically, primary transfer rollers 12Y, 12M, 12C and 12BK apply a voltage at different timings from upstream to downstream in the direction A1 so that the toner images are sequentially superimposed on the same position of the transfer belt 11. The primary transfer rollers 12Y, 12M, 12C and 12BK are disposed at positions facing the photoconductor drums 20Y, 20M, 20C and 20BK via the transfer belt 11.

The transfer belt 11 has a volume resistance (conductivity) of $10^5$ Ω.cm to $10^{11}$ Ω.cm. When the surface resistance is lower than $10^5$ Ω2/sq., the toner images may be changed during discharge upon transfer of the toner image from the photoconductor drums 20Y, 20M, 20C and 20BK onto the transfer belt 11 (so-called toner scattering during transfer). When the surface resistance exceeds $10^{11}$ Ω/sq., the counter charges against the toner images remain on the transfer belt 11 after transfer of the toner images from the transfer belt 11 onto the recording paper, resulting in that an afterimage may be formed on the image obtained in the next cycle.

The transfer belt 11 may be, for example, a belt-shaped or cylindrical plastic, which is formed by extruding a kneaded product of a thermoplastic resin and a conductive polymer and/or conductive particles such as carbon black and metal oxides (e.g., tin oxide and indium oxide). Alternatively, the transfer belt 11 may be an endless belt which is formed through centrifugal molding under heating of a resin liquid containing a thermocrosslinkable monomer or oligomer and optionally containing the aforementioned conductive particles and/or conductive polymer.

When a surface layer is provided on the transfer belt 11, the surface layer may be made of the composition containing the materials (except for the charge transport material) for forming a surface layer of the below-described photoconductor drum 20Y. In this case, the composition may be appropriately changed in resistance with a conductive compound before use.

The transfer belt 11 has, at the edges, skew-preventing guides (not shown) serving as skew-preventing members. The skew-preventing guides are disposed for preventing the transfer belt 11 from skewing toward any direction perpendicular to the paper surface of FIG. 1 during the rotation in the direction A1. The skew-preventing guide is made of urethane rubber, and may also be made of other rubbers such as silicone rubber.

The image forming apparatus 100 includes, in the main body 99, four image forming units 60Y, 60M, 60C and 60BK, a transfer belt unit 10, a secondary transfer roller 5 and a light-scanning device 8. Here, the transfer belt unit is an intermediate transfer unit which has the transfer belt 11 and is disposed below the photoconductor drums 20Y, 20M, 20C and 20BK so as to face them. The secondary transfer roller 5 is a secondary transfer bias roller serving as a transfer member, which is disposed so as to face the transfer belt 11, and is moved and rotated correspondingly to the rotation of the transfer belt 11. The light-scanning device 8 is a light-writing unit serving as a latent image forming unit, which is disposed above the image forming units 60Y, 60M, 60C and 60BK so as to face them.

The image forming apparatus 100 also includes, in the main body 99, a sheet-feeding device 61, a pair of registration rollers 4 and a sensor (not shown). Here, the sheet-feeding device 61 is a paper-feeding cassette (paper-feeding mechanism) capable of storing many sheets of recording paper, which are conveyed to between the photoconductor drums 20Y, 20M, 20C and 20BK and the transfer belt 11. The registration rollers feed the recording medium, which have been conveyed from the sheet-feeding device 61, to a secondary transfer portion 97 between the transfer belt 11 and the secondary transfer roller 5 at a predetermined timing corresponding to the toner image formation by the image forming units 60Y, 60M, 60C and 60BK. The sensor detects that the top end of each recording medium reached the registration rollers 4.

The image forming apparatus 100 also includes, in the main body 99, a fixing device 6, paper-discharging rollers 7 and a discharge tray 17. Here, the fixing device is a fixing unit in the belt-fixing method which is for fixing the transferred toner image on the recording medium. The paper-discharging rollers are a pair of rollers for discharging the fixed recording medium to the outside of the main body 99. The discharge tray 17 receives the recording media discharged by the discharging rollers 7 to the outside of the main body 99.

The image forming apparatus 100 also includes, above the main body 99, a reading device 14 and an automatic document feeder (i.e., ADF) 15. The reading device reads an image of the original document. The automatic document feeder is disposed above the reading device 14 and feeds the original document to the reading device 14.

The mage forming apparatus 100 also includes driving devices (not shown), a power supply (not shown), bias-controlling units (not shown) and a controlling unit (not shown).

Here, the driving devices rotate the photoconductor drums 20Y, 20M, 20C and 20BK. The power supply and bias-controlling units are bias-applying units configured to apply secondary transfer bias to the secondary transfer roller 5. The controlling unit contains CPU, a memory, etc. and controls overall operation of the image forming apparatus 100 on the basis of, for example, the data detected by various detection units.

The transfer belt unit 10 includes, in addition to the transfer belt 11, primary transfer rollers 12Y, 12M, 12C and 12BK (primary transfer bias rollers), a drive roller 72, which is a driving member around which the transfer belt 11 is wound, a cleaning counter roller 74, supporting rollers 75 and 77, which support the transfer belt 11 together with the drive roller 72 and the cleaning counter roller 74, and a cleaning device 13, which is disposed so as to face the transfer belt 11 and cleans the transfer belt 11.

The transfer belt unit 10 also has a driving system (not shown), by which the drive roller 72 is rotated, and a power supply (not shown) and bias-controlling units (not shown), which are bias-applying units configured to apply primary transfer bias to the primary transfer rollers 12Y, 12M, 12C and 12BK.

The primary transfer rollers 12Y, 12M, 12C and 12BK press the back surface of the transfer belt 11 against the photoconductor drums 20Y, 20M, 20C and 20BK so as to form primary transfer nips.

Due to the primary transfer biases, a primary transfer electrical field is formed in the primary transfer nips between the photoconductor drums 20Y, 20M, 20C and 20BK and the primary transfer rollers 12Y, 12M, 12C and 12BK. The toner images of colors formed on the photoconductor drums 20Y, 20M, 20C and 20BK are primarily transferred onto the transfer belt 11 by virtue of the primary transfer electrical field and the nip pressure.

The drive roller 72 is disposed so as to come into contact with the secondary transfer roller 5 via the transfer belt 11, and forms a secondary transfer nip.

The supporting roller 75 serves as a tension roller (press member) which gives the transfer belt 11 a predetermined tension suitable for transfer.

The cleaning device 13 has a cleaning brush and a cleaning blade which are disposed so as to face and be in contact with the transfer belt 11 (detail illustration is omitted), and is configured to scrape off and remove foreign matter (e.g., residual toner particles) on the transfer belt 11 by the cleaning brush and the cleaning blade so as to clean the transfer belt 11.

The sheet-feeing device 61 accommodates many recording media in a stacked state (in bundle), and is disposed in multiple steps at the lower side of the main body 99. The sheet-feeing device 61 feeds a recording medium to a pair of registration rollers 4 at a predetermined timing.

The recording medium, which have been fed from the sheet-feeing device 61, reach the registration rollers 4 through the paper-feeding pathway, and are sandwiched between the registration rollers 4.

The fixing device 6 has a belt unit 62 and a press roller 63 pressed against the belt unit 62. The belt unit 62 has an endless fixing belt 64, a fixing roller 65, which moves the endless fixing belt 64 with supporting it, and a heating roller 66, which has an heat source (not shown) therein and supports the endless fixing belt 64 together with the fixing roller 65.

The fixing device 6 fixes the toner image, by the action of heat and pressure, on a surface of the recording medium which has fed to the fixing part (press-contact portion) between the belt unit 62 and the press roller 63.

Next, description will be given with respect to the image forming unit 60Y containing the photoconductor drum 20Y, among the image forming units 60Y, 60M, 60C and 60BK. Notably, since the configuration of the image forming unit 60Y is substantially the same as those of the other image forming units, detail descriptions thereof are appropriately omitted. Also, for the sake of convenience in the following description, the reference numerals of the constituent members of the image forming unit 60Y are used to denote the constituent members of the other image forming units, or are omitted.

As shown in FIG. 2, the image forming unit 60Y containing the photoconductor drum 20Y has, around the photoconductor drum 20Y, a primary transfer roller 12Y, a cleaning device 70Y (drum cleaning device serving as a cleaning unit), a protecting film-forming device 40Y (protecting agent-supplying device serving as a protecting film-forming unit), an charge-eliminating device (not shown), a charging device 90Y (serving as a charging unit) and a developing device 80Y (a developing device serving as a developing unit). These members are disposed so as to face the photoconductor drum 20Y along the direction B1 (in which the photoconductor drum 20Y is rotated); i.e., counterclockwise in the figure. The protecting film-forming device is a protecting agent-applying unit configured to apply a protecting agent 42Y (image bearing member-protecting agent) to the photoconductor drum 20Y. The charge-eliminating device has a charge-eliminating lamp serving as a charge-eliminating unit.

The photoconductor drum 20Y, the cleaning device 70Y, the protecting film-forming device 40Y, the charge-eliminating device, the charging device 90Y and the developing device 80Y are integrally provided so as to form a process cartridge 68Y. The process cartridge 68Y is detachably arranged to the main body 99. In this manner, when the members are provided in the form of the process cartridge which can be used as a replacement part, the maintenance ability is remarkably improved, which is quite preferred.

The photoconductor drum 20Y has a conductive substrate and a photoconductive layer thereon; i.e., an OPC photoconductor having an organic photoconductive layer. The detail description thereof will be given below.

The cleaning device 70Y has a cleaning blade 78Y, a spring 79Y and a recovering chamber (not shown) along the direction indicated by arrow B1. The cleaning blade 78Y is a cleaning member which is disposed downstream of the position where the toner image on the photoconductor drum 20Y is transferred onto the transfer belt 11 by the primary transfer roller 12Y but upstream of the position where a protecting agent 42Y is supplied from the protecting film-forming device 40Y. The tip of the cleaning blade 78Y is brought into contact with the photoconductor drum 20Y so as to scrape off and remove toner particles remaining after transfer on the photoconductor drum 20Y and foreign matters (e.g., carriers and paper dust) thereon, followed by recovering and cleaning them. The spring 79Y causes the cleaning blade 78Y to be pressed against the photoconductor drum 20Y using a predetermined elastic force. The recovering chamber recovers the post-transfer residual toner particles or other foreign matters which have been removed by the cleaning blade 78Y from the photoconductor drum 20Y.

The cleaning blade 78Y is brought into contact with the photoconductor drum 20Y at an angle related to a so-called counter type (leading type).

The charging device 90Y is a charging unit configured to uniformly charge a surface of the photoconductor drum 20Y. The charging device 90Y has a charging roller 91Y, a cleaning roller 92Y and a high-voltage power source (not shown). The charging roller 91Y is a charging member which is disposed closely to the surface of the photoconductor drum 20Y. The cleaning roller 92Y is a cleaning member disposed so as to come into contact with the charging roller 91Y, which side is opposite to a side where the charging roller 91Y faces the photoconductor drum 20Y, and cleans the charging roller 91Y. The high-voltage power source is a voltage-applying unit configured to apply to the charging roller 91Y a voltage which is formed by superimposing a direct-current voltage on an alternating-current voltage, so that the voltage contains a direct-current component and an alternating-current component.

The method of charging the photoconductor drum 20Y may be, for example, a method of charging the photoconductor drum 20Y by disposing the charging roller 91Y close to the photoconductor drum 20Y in non-contact manner (close-contact charging method) (like the charging device 90Y in this embodiment), and a method of charging the photoconductor drum by disposing such a charging member as the charging roller 91Y so as to come into contact with the photoconductor drum 20Y (contact-charging method (contact method)). The high-voltage power supply may be that applying only a direct-current voltage to the charging roller 91Y.

The charging device 90Y charges the photoconductor drum 20Y through discharge within a small gap between the charging roller 91Y and the photoconductor drum 20Y upon application of voltage on which alternating voltage is superposed with the high-voltage power supply. As compared with dischargers based on corona discharge using a discharging wire (e.g., so-called corotron and scorotron), the above charging method considerably reduces the amount of ozone generated during charging.

The light-scanning device 8 writes a latent electrostatic image in response to image information of a visible yellow image to be formed by the developing device 80Y. To form the latent electrostatic image, the light-scanning device applies modulated and polarized laser light L to a region between the charging region (where the charging device 90Y faces the photoconductor drum 20Y) and the developing region (where the developing device 80Y faces the photoconductor drum 20Y), to thereby expose, through spot irradiation, the surface of the photoconductor drum 20Y having been charged by the charging device 90Y. The light-scanning device 8, as shown in FIG. 1, has a light source 31, a polygon mirror 32 (which is a polygon column rotating at high speed), a lens if) 33, a reflective mirror 34, etc.

As shown in FIG. 2, the developing device 80Y has a developing roller 81Y, which is disposed close to the photoconductor drum 20Y so as to face the photoconductor drum 20Y, a doctor blade 82Y, which adjusts the thickness of the developer on the developing roller 81Y to a certain thickness, a first feeding screw 83Y and a second feeding screw 84Y, which are disposed so as to face each other and stir and feed a developer to the developing roller 81Y, a partition wall 87Y, which is disposed between the first feeding screw 83Y and the second feeding screw 84Y, a toner bottle 88Y containing yellow toner, an bias-applying unit (not shown), which is configured to apply to the developing roller 81Y a developing bias of direct-current component.

The developing roller 81Y has a developing sleeve (not shown) which is a developer carrier carrying a developer on a surface thereof. The bias-applying unit is configured to apply, to the developing sleeve, an appropriate amount of a developing bias corresponding to the difference between exposed portions and unexposed portions on the photoconductor drum 20Y.

The developing device 80Y is divided by a partition wall 87Y into a first feeding part and a second feeding part. The first feeding part houses the developing roller 81Y and the first feeding screw 83Y. The second feeding part houses the second feeding screw 84Y.

While being rotated with a driving unit, the first feeding screw 83Y feeds the developer contained in the first feeding part to the developing roller 81Y from the back to the front with respect to the paper surface of FIG. 2. The developer is fed by the first feeding screw 83Y to the position near the edge of the first feeding part, and then, enters the second feeding part through an opening (not shown) formed in the partition wall 87Y.

In the second feeding part, the second feeding screw 84Y is rotated with the driving unit, so as to feed the developer, which has been fed from the first feeding part, in a direction opposite to the direction in which the developer is fed by the first feeding screw 83Y. The developer is fed to a position near the edge of the second feeding part by the second feeding screw 84Y, and then, is returned to the first feeding part through another opening (not shown) formed in the partition wall 87Y.

The developer contained in a developer case 85Y is a two-component developer containing magnetic carriers and yellow toner particles. The yellow toner particles are added and supplied from the toner bottle 88Y to the developer. The thus-supplied yellow toner particles and the developer are transferred under mixing and stirring by the first feeding screw 83Y and the second feeding screw 84Y. As a result, the toner particles and the developer are frictionally charged and fed and carried onto the developing roller 81Y.

The developing roller 81Y, after the amount of the developer carried thereon, i.e., the thickness of a layer of the developer, has been controlled by the doctor blade 82Y, conveys an appropriate amount of the developer to the developing region between the developing roller 81Y and the photoconductor drum 20Y in accordance with the rotation thereof. Then, through the application of developing bias generated by the bias-applying unit, the yellow toner particles contained in the developer are electrically transferred onto a latent electrostatic image formed on the photoconductor drum 20Y, to thereby form a yellow toner image (visible image) corresponding to the latent electrostatic image.

The developer in which the yellow toner has been consumed after development is returned to the developing device 80Y in accordance with the rotation of the developing roller 81Y.

In this embodiment, a developing bias of direct-current component is applied with the bias-applying unit. But, the developing bias may be an alternating current component or an alternating current component superimposed on a direct-current component.

The protecting film-forming device 40Y has a protecting agent 42Y and a brush roller 47Y. The protecting agent 42Y is a solid lubricant molded in the form of a bar. The brush roller 47Y is a fur brush serving as a scraping member, which is a protecting agent feeding member. The protecting agent feeding member is a feeding member which scrapes off and feeds the protecting agent 42Y to the photoconductor drum 20Y for protecting the photoconductor drum 20Y.

The protecting film-forming device 40Y also has a holder 41Y, a spring 48Y and a protecting layer-forming mechanism 49Y. Here, the holder 41Y supports the protecting agent 42Y at a surface opposite to the surface facing the photoconductor drum 20Y. The spring is a pressing spring, which is press force-applying mechanism. The pressing spring is an elastic member which presses the protecting agent 42Y against the brush roller 47Y via the holder 41Y. The protecting layer-forming mechanism is for forming a protective film by coating the photoconductor drum 20Y with the protecting agent 42Y which has been supplied by the brush roller 47Y to the photoconductor drum 20Y.

In order for the protecting agent 42Y to be scraped off and consumed by the brush roller 47Y uniformly as a whole in the width direction, the protecting agent 42Y and the brush roller 47Y have the same length in the direction perpendicular to the front surface of FIG. 2 (i.e., in the width direction), and are disposed over the same region in the width direction. Also, the spring 48Y is adjusted so as to press the protecting agent 42Y against the brush roller 47Y at a constant press force over time and a uniform pressure in the longitudinal direction (with regard to the specific structure, for example, see JP-A No. 2007-293240).

The protecting agent 42Y and the brush roller 47Y each have a length (in the width direction) equal to or larger than the length (in the width direction) of the image forming region of the photoconductor drum 20Y. In the width direction, the protecting agent 42Y and the brush roller 47Y are disposed so as to include the image forming region of the photoconductor drum 20Y. With this configuration, the protecting agent 42Y is supplied by the brush roller 47Y to the image forming region of the photoconductor drum 20Y uniformly in the width direction.

The protecting agent 42Y is attached to a surface of the photoconductor drum 20Y and formed into a film to generate its protection effect, and thus is relatively plastically deformable. When a block-shaped protecting agent 42Y is directly pressed against a surface of the photoconductor drum 20Y to supply the protecting agent 42Y thereto, the protecting agent is supplied in excess, which is not only poor in efficiency in forming a protective layer, but also may cause a problem, for example, the transmission of light in an exposure process is inhibited during formation of a latent electrostatic image because plural protective layers are formed. Thus, types of components of usable protecting agents are limited. However, by providing the brush roller 47Y between the protecting agent 42Y and the photoconductor drum 20Y, the appropriate amount of the protecting agent 42Y can be uniformly supplied to a surface of the photoconductor drum 20Y, even with use of a soft protecting agent as the protecting agent 42Y.

The protecting film-forming mechanism 49Y has a coating blade 43Y and a spring 44Y. The coating blade 43Y is a film-forming member (layer-forming member) which comes into contact with the photoconductor drum 20Y at the end thereof, so as to level the protecting agent 42Y supplied by the brush roller 47Y to the photoconductor drum 20Y to form a layer thereon. The spring 44Y is an elastic member which presses the coating blade 43Y against the photoconductor drum 20Y at a predetermined elastic force.

The coating blade 43Y has a blade 45Y and a blade support 46Y. The blade 45Y comes into contact with the photoconductor drum 20Y. The blade support 46Y is rotatable around a support shaft 49*a*Y and supports the blade 45Y. Also, the blade support 46Y is pressed by the spring 44Y. The blade 45Y and the blade support 46Y are attached to each other through adhesion, in order to endure pressing of the end of the blade 45Y against the surface of the photoconductor drum 20Y. Alternatively, these members may be attached to each other through any other means such as fusion.

The length (in the width direction) of the coating blade 43Y is equal to or larger than the length (in the width direction) of the image forming region of the photoconductor drum 20Y. The coating blade is disposed so as to include the image forming region of the photoconductor drum 20Y in the width direction. With this configuration, the coating blade 43Y uniformly comes into contact with at least the image forming region of the photoconductor drum 20Y in the width direction, and forms a uniform film on at least the image forming region of the photoconductor drum 20Y in the width direction.

The brush roller 47Y is a rotation member which rotates around an axis (not shown) thereof in a certain direction D1 so as to scrape off the protecting agent 42Y. The rotational center of the brush roller 47Y is indicated by O in FIGS. 7 and 9. The protecting agent 42Y is scraped off by the rotation of the brush roller 47Y in the direction D1, and the scraped agent is supplied by the brush roller 47Y to the photoconductor drum 20Y so as to protect the photoconductor drum 20Y.

The protecting film-forming device 40Y having the above-described configuration supplies the protecting agent 42Y to the photoconductor drum 20Y as follows. Specifically, the brush roller 47Y is rotated around the axis thereof at a predetermined linear velocity different from the rotation speed of the photoconductor drum 20Y in the direction D1, which is the counter direction with respect to the rotation direction B1 of the photoconductor drum 20Y. The brush roller scrapes off and holds and transfers the protecting agent 42Y to the position where the brush roller 47Y comes into contact with the surface of the photoconductor drum 20Y.

Although the protecting agent 42Y applied to the photoconductor drum 20Y may not form a sufficient protecting film on the photoconductor drum 20Y depending on the material of the protecting agent 42Y, the protecting agent 42Y is pressed by the coating blade 43Y against the surface of the photoconductor drum 20Y and is stretched thereon, whereby a thin layer (film) of the protecting agent is formed, in other words, the protecting agent is layered. In this manner, a film of the protecting agent is formed assuredly and uniformly.

The detail of the protecting film-forming device 40Y will be described below.

In the above-described image forming unit 60Y, image formation is performed through a negative-positive process. While the photoconductor drum 20Y is being rotated in the direction B1, the surface thereof is uniformly negative-charged by the charging device 90Y. Then, the surface is scanned by being exposed to laser light L emitted from the light-scanning device 8 to form a latent electrostatic image of yellow. In this state, the photoconductor drum 20Y is scanned by being exposed along the rotation axis thereof. The absolute value of the potential at the exposed portion is lower than the absolute value of the potential at the unexposed portion.

The latent electrostatic image is developed by the developing device 80Y with yellow toner contained in the developer. The yellow toner image obtained after development is primarily transferred by the primary transfer roller 12Y onto the transfer belt 11 moving in the direction A1. The residual toner remaining on the photoconductor drum 20Y after transfer is removed by the cleaning device 70Y. Then, the protecting film-forming device 40Y applies the protecting agent 42Y. After that, the residual charges are eliminated by a charge-eliminating device. The photoconductor drum 20Y is subjected to the next charging by the charging device 90Y and charge-eliminating.

In this state, the cleaning device 70Y removes the partially or entirely deteriorated protecting agent on the photoconductor drum 20Y, in addition to other matters such as the residual toner. The protecting film-forming device 40Y forms a protecting film of the protecting agent on the surface of the photoconductor drum 20Y having undergone cleaning.

The cleaning device 70Y may be omitted by imparting cleaning function to the protecting layer-forming mechanism 49Y or the coating blade 43Y provided therein.

However, it is necessary to be different between a member having the function of cleaning the photoconductor drum 20Y and a member having the function of forming a protective layer in the contact states of these members with the photoconductor drum 20Y, such as a material of the member to be in contact with the photoconductor drum 20Y, and required press force against the photoconductor drum 20Y.

Thus, as in this embodiment, preferably, these members are provided as separate members rather than as a single member. Specifically, like the present embodiment, it is preferred that in the direction B1, the cleaning device 70Y be disposed upstream and the protecting layer-forming mechanism 49Y be disposed downstream. As a result, a protective layer containing no impurity, such as toner, is more certainly formed on the photoconductor drum 20Y. Notably, also in this embodiment, since the cleaning device 70Y cleans the protecting agent on the surface of the photoconductor drum 20Y, the cleaning device 70Y is regarded as a protecting agent-cleaning mechanism, which is a protecting agent-cleaning unit provided in the protecting film-forming device 40Y.

Similarly, toner images of the other colors are correspondingly formed on the other photoconductor drums 20M, 20C and 20BK, and then primarily transferred sequentially by the primary transfer rollers 12M, 12C and 12BK onto the same position of the transfer belt 11 moving in the direction A1. While the transfer belt 11 is rotated in the direction A1, the composite toner image formed on the transfer belt 11 is moved to the secondary transfer nip where the secondary transfer roller 5 faces the transfer belt. In this nip, the composite image adheres closely to a recording paper, and is secondarily transferred thereonto by the secondary transfer bias or the nip pressure, whereby a full color image is formed on the recording paper.

After the recording paper has been fed to between the transfer belt 11 and the secondary transfer roller 5, the recording paper is fed by a paper-feeding roller 3 from the sheet-feeding device 61. Then, based on detection signals obtained by the sensor, the recording paper is fed by a pair of registration rollers 4 at the timing when the top end of the toner image on the transfer belt 11 faces the secondary transfer roller 5.

With the bias-applying unit, a potential having the opposite polarity to that of the charged toner is applied to the secondary transfer roller 5.

The toner images of all colors are transferred and carried onto the recording paper. Then, the recording paper enters the fixing device 6 where the toner image is fixed thereon by the action of heat and pressure applied when the recording paper passes through a fixing part formed between the press roller 63 and the belt unit 62, whereby a full color image is fixed on the recording paper. The recording paper, on which the toner image is fixed and after passed through the fixing device 6, passes between the discharging rollers 7 and is stacked on a discharge tray 17 located in the upper section of the main body 99. The surface of the transfer belt 11, having passed through the secondary transfer nip after secondary transfer, is cleaned by a cleaning brush and a cleaning blade equipped with the cleaning device 13 for the next developing step.

The protecting film-forming device 40Y will be described below. Notably, this protecting film-forming device has the same configuration as the other protecting film-forming devices provided in the image forming units 60M, 60C and 60BK. Thus, the description of the other protecting film-forming devices is omitted.

The protecting agent 42Y contains at least a fatty acid metal salt and an inorganic lubricant. For the following reasons, the protecting agent 42Y is formed by mixing the inorganic lubricant with the fatty acid metal salt. Specifically, when affected by discharge in a charging step, the protecting agent 42Y decreases in lubricity to a less extent than the protecting agent containing the fatty acid metal salt as a main component. In addition, the protecting agent 42Y is suitably used for suppressing or preventing toner having small particles and high circularity from running through a cleaning blade 78Y to stain a charging roller 91Y, to adversely affect formed images and to abrade the cleaning blade 78Y, whereby the protecting agent 42Y is suitable for elongation for service lives of the protecting film-forming device 40Y and the process cartridge 68Y. Furthermore, the protecting agent 42Y is suitably used for suppressing or preventing itself (together with toner particles) from running through the cleaning blade 78Y to stain the charging roller 91Y, whereby the protecting agent 42Y is suitable for elongation of a service life of the process cartridge 68Y.

Examples of the fatty acid metal salt include, but are not limited to, barium stearate, lead stearate, iron stearate, nickel stearate, cobalt stearate, copper stearate, strontium stearate, calcium stearate, cadmium stearate, magnesium stearate, zinc stearate, zinc oleate, magnesium oleate, iron oleate, cobalt oleate, copper oleate, lead oleate, manganese oleate, zinc palmitate, cobalt palmitate, lead palmitate, magnesium palmitate, aluminum palmitate, calcium palmitate, lead caprylate, lead caprate, zinc linoleate, cobalt linoleate, calcium linoleate, zinc ricinoleate, cadmium ricinoleate and mixtures thereof. These may be used in combination. Most preferably, the fatty acid metal salt contains zinc stearate. This is because, as is clear from Examples given below, zinc stearate contributes to effective protection of the photoconductor drum 20Y, and also, stearic acid is the cheapest among higher fatty acids. Furthermore, a zinc salt of stearic acid is a highly hydrophobic, remarkably stable compound. Thus, the protecting agent 42Y preferably contains zinc stearate.

The inorganic lubricant refers to a compound which is cleaved by itself to exhibit lubricity or is slid therein. Examples of the inorganic lubricant include, but are not limited to, boron nitride, mica, talc, kaolin, plate-shaped alumina, sericite, molybdenum disulfide, tungsten disulfide, montmorillonite, calcium fluoride and graphite. For example, boron nitride is a compound having hexagonal lattice planes (layers) (each being formed of firmly bonded atoms) which are superimposed on top of the other at large intervals via weak van der Waals force, and are easily cleaved to exhibit lubricity. A compound having a layer structure formed through metal bonds, covalent bonds or ion bonds, in which the layers bonded to each other only by Van der Waals force is called as a two-dimensional structure.

As is clear from Examples given below, boron nitride is most suitable for protecting the charging roller 91Y from staining, for protecting a photoconductor from filming. Therefore, the protecting agent 42Y in the present embodiment preferably contains boron nitride as the inorganic lubricant. The protecting agent 42Y is any protecting agent as long as it contains at least one type of the above-described inorganic lubricants.

The protecting agent 42Y is a solid, molded in the form of a bar as described above. Examples of known methods for forming the protecting agent 42Y so as to have the bar shape (a block shape) include compression molding and melt molding. The protecting agent 42Y may be produced into a solid block shape by any method. The protecting agent obtained through melt molding is harder than that obtained through compression molding. Thus, the amount of the protecting agent obtained through melt molding supplied to the photoconductor drum 20Y is problematically decreased. Particularly, this problem easily occurs, since the protecting agent 42Y is formed by incorporating an inorganic lubricant into a fatty acid metal salt.

The protecting agent 42Y is molded into a block-shaped solid product through compression molding, in order to secure the amount of the former lubricant supplied to the photoconductor drum 20Y, to provide elongated service lives to the photoconductor drum 20Y, the cleaning blade 78Y, and the charging roller 91Y, etc.

With Reference to FIGS. 3 to 6, description will be given with respect to an exemplary apparatus and method for producing the protecting agent 42Y. Notably, the apparatus and method for producing the protecting agent 42Y is the same as apparatuses and methods for producing protecting agents used in the protecting film-forming devices of the image forming units 60M, 60C and 60BK. Thus, these apparatuses and methods for producing the protecting agents for the image forming units 60M, 60C and 60BK are omitted.

Figure 3:
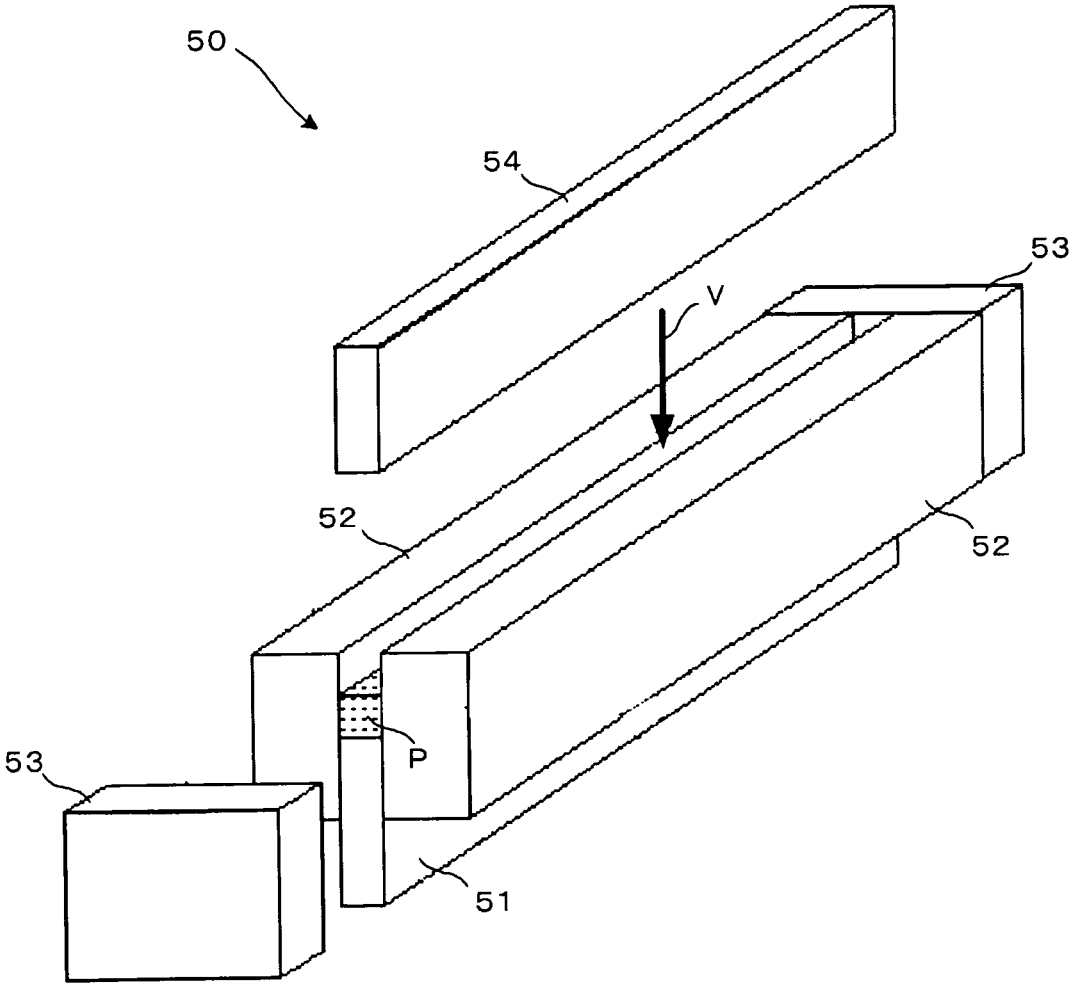
FIG. 3 is a partially exploded perspective view schematically showing an apparatus for producing the image bearing member-protecting agent shown in FIG. 2.
Figure 4:
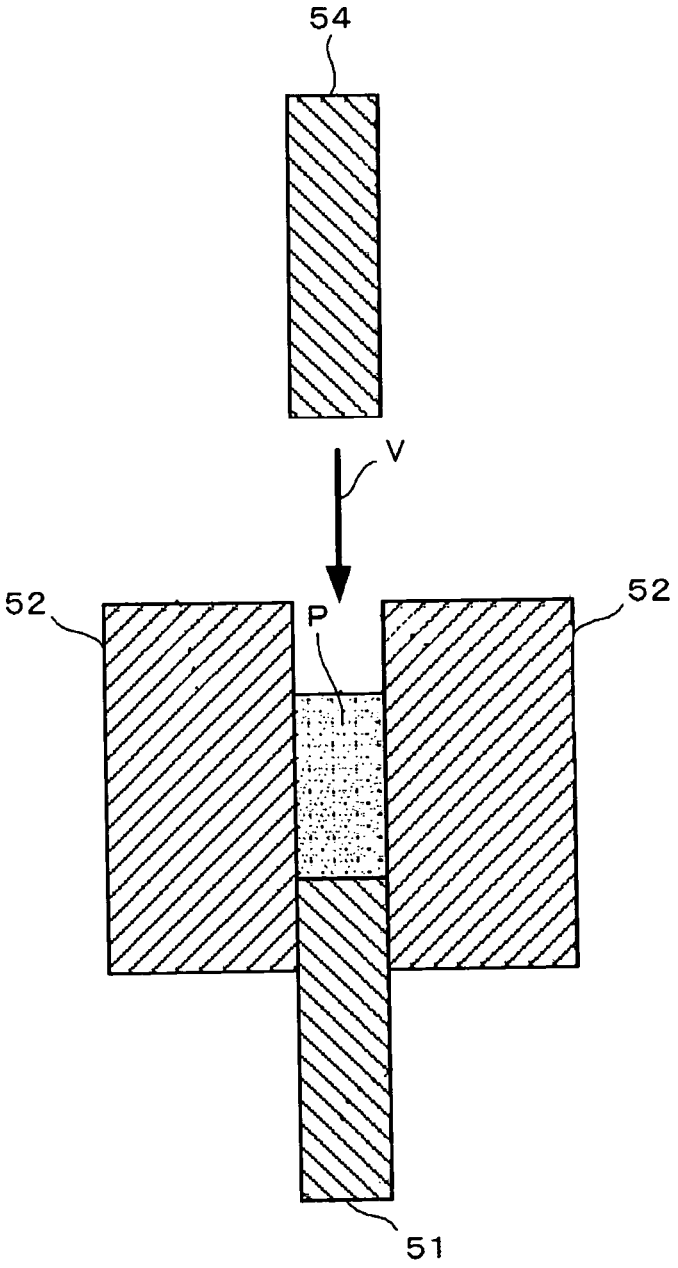
FIG. 4 is a sectional side view of the apparatus shown in FIG. 3.

As shown in FIGS. 3 and 4, a production apparatus 50 for the protecting agent 42Y has a lower mold 51, a pair of side molds 52, a pair of end molds 53, and an upper mold 54. In this production apparatus, the lower mold 51 forms a surface of the protecting agent 42Y at the side where the protecting agent is supported by the holder 41Y, i.e. the back surface (indicated by B in FIG. 6) shown in FIG. 6. The side molds 52 are disposed so as to sandwich the lower mold 51 and form side surfaces of the protecting agent 42Y extending in the longitudinal direction thereof. The end molds 53 are disposed so as to sandwich the lower mold 51 and the side molds 52 and form end surfaces of the protecting agent 42Y in the longitudinal direction thereof. The upper mold 54 forms a surface of the protecting agent 42Y at the side of the brush roller 47Y.

In FIG. 3, one of the end molds 53 is shown in an exploded manner. This end mold is actually disposed at a position facing the other end mold 53. During the below-described compression molding of the protecting agent 42Y, the end molds 53, the lower mold 51 and the side molds 52 define a partially confined space that opens in a direction in which the upper mold 54 enters the space. In a direction indicated by an arrow V in FIGS. 3 and 4, the upper mold 54 moves to enter the partially confined space, whereby a completely confined space is formed by the lower mold 51, the side molds 52, the end molds 53 and the upper mold 54.

Figure 5:
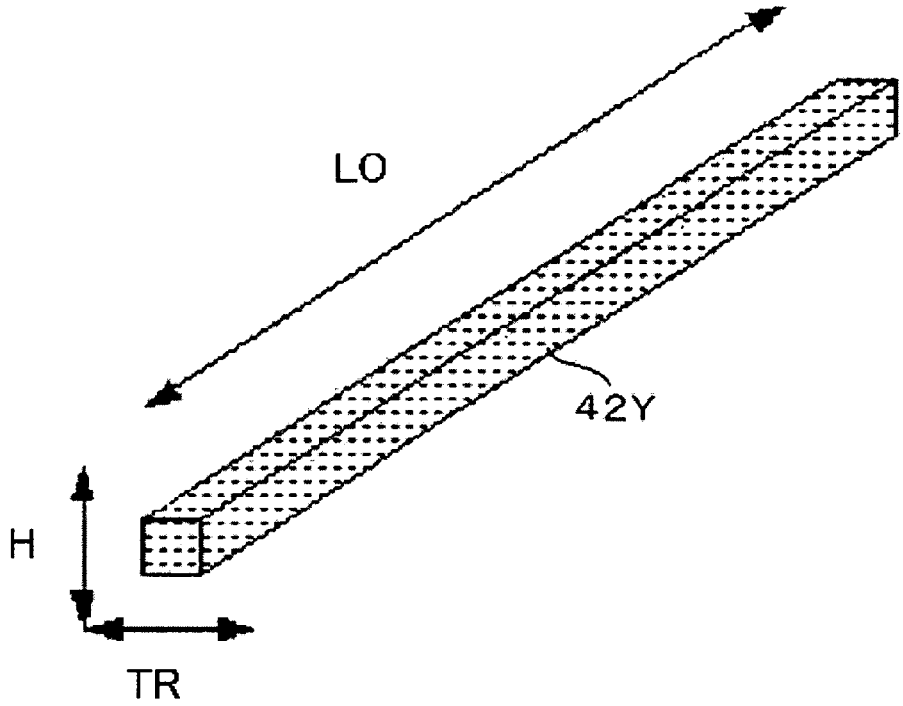
FIG. 5 is a perspective view of the image bearing member-protecting agent which is contained in the image forming apparatus shown in FIG. 2 and is produced by the apparatus shown in FIGS. 3 and 4.

For producing the protecting agent 42Y, powder P containing zinc stearate and boron nitride is charged into the partially confined space formed by the molds except for the upper mold 54. The powder P may be powdered or granular, or be in a mixed state thereof. After charging of the powder P has been completed, the upper mold 54 is made to enter the partially confined space in the direction V, to thereby form a completely confined space while pressing. As a result, as shown in FIG. 5, the protecting agent 42Y is formed into a rectangular shape having a long side in the longitudinal direction (indicated by LO in FIG. 5). The width direction corresponds to a scanning direction. Note that, in FIG. 5, H corresponds to the height direction, and TR corresponds to the transverse direction.

Figure 6:
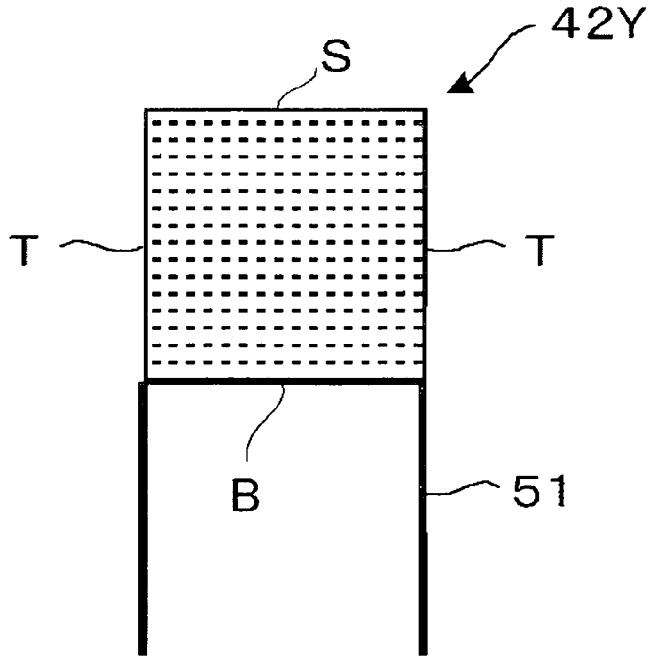
FIG. 6 is a front elevational view of the image bearing member-protecting agent which is contained in the image forming apparatus shown in FIG. 2 and is produced by the apparatus shown in FIGS. 3 and 4.

The thus formed protecting agent 42Y has a planer surface to be scraped S, which is opposite to the back surface (indicated by B in FIG. 6) thereof as shown in FIG. 6. The surface to be scraped S is a surface facing the brush roller 47Y in the state that the protecting agent 42Y is mounted in the protecting film-forming device 40Y, and to be scraped off by the brush roller 47Y. In FIG. 6, the direction vertical to paper surface corresponds to the width direction. In FIG. 6, T denotes a surface extending in the longitudinal direction.

As described above, the protecting film-forming device 40Y is equipped with the spring 48Y. A biasing force of the spring 48Y allows the protecting agent 42Y to be uniformly pressed in the longitudinal direction at a constant pressure for a long period of time against the brush roller 47Y. Thus, even though the protecting agent 42Y is scraped off by the brush roller 47Y over time, and decreased to a small amount, the proper amount of the protecting agent 42Y is held by the brush roller 47Y, and then the protecting agent 42Y is in contact with the photoconductor drum 20Y, to thereby supply the proper amount of the protecting agent 42Y to the photoconductor drum 20Y.

Here, it has been known that the amount of the protecting agent 42Y scraped off by the brush roller 47Y and supplied to the photoconductor drum 20Y varies depending on the deterioration of the brush roller 47Y with time, and whether or not the toner attaches to the brush roller 47Y. Depending on the conditions whether or not the toner attaches to the brush roller 47Y, the amount of the protecting agent 42Y supplied to the photoconductor drum 20Y varies, since the protecting-agent is scraped off by the toner attached to the brush roller 47Y together with the brush roller 47Y.

Since the protecting agent 42Y contains the fatty acid metal salt and the inorganic lubricant, and the toner running through dose not occur or slightly occurs between the cleaning blade 78Y and the photoconductor drum 20Y, the toner does not attach to the brush roller 47Y. Thus, the amount of the protecting agent 42Y supplied to the photoconductor drum 20Y depends on the deterioration of the brush roller 47Y. Therefore, when the brush roller 47Y is deteriorated with time, the amount of supplying the protecting agent 42Y decreases, and the photoconductor drum 20Y cannot be protected, possibly causing filming on the photoconductor drum 20Y. In order to prevent such problems, the spring 48Y presses the brush roller 47Y against the protecting agent 42Y at high pressure from the beginning of supplying the protecting agent.

Figure 7A:
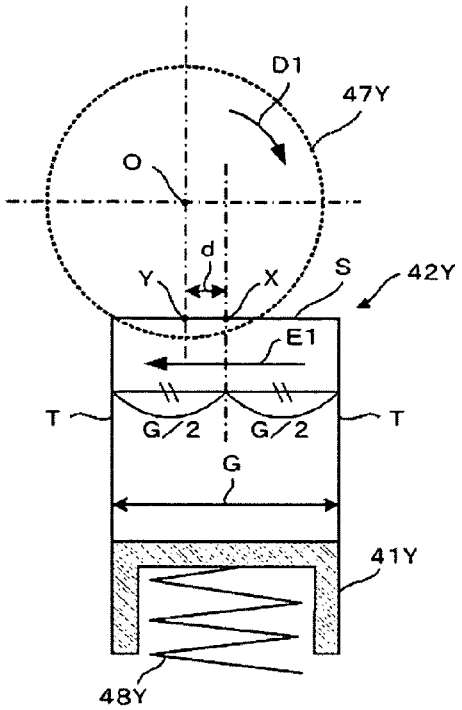
FIGS. 7A and 7B are schematic front sectional views of explaining the relative positional relation between the image bearing member-protecting agent and a rotation member shown in FIG. 2.
Figure 7B:
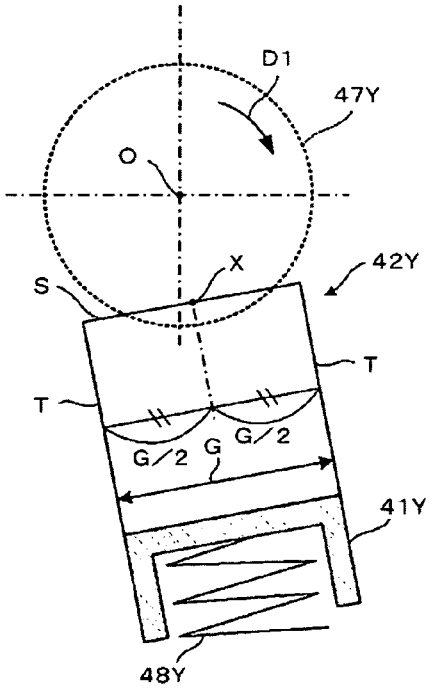
Figure 8A:
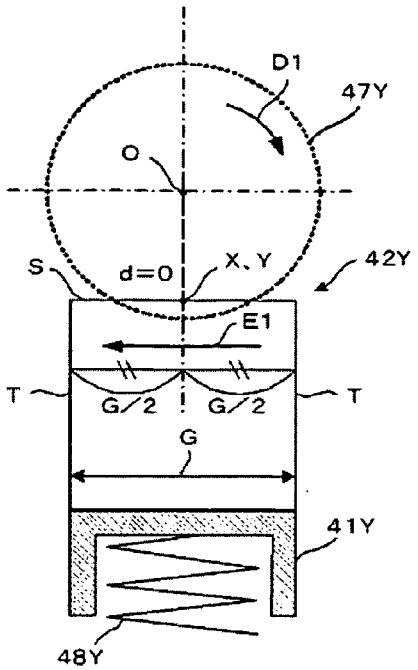
FIGS. 8A and 8B each are schematic front sectional view of an example of the unsuitable relative positional relation between the image bearing member-protecting agent and the rotation member.
Figure 8B:
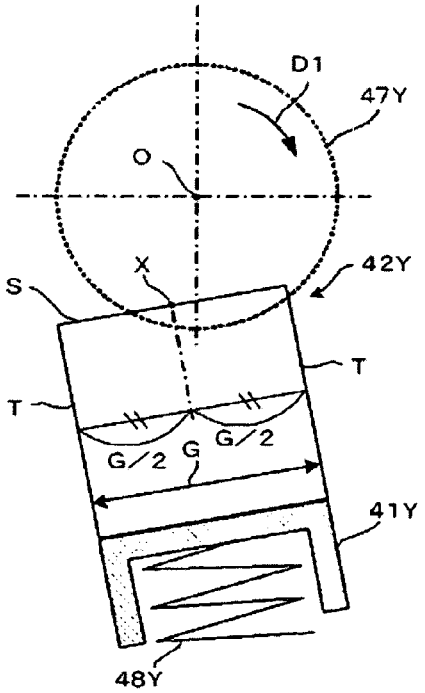
Figure 9A:
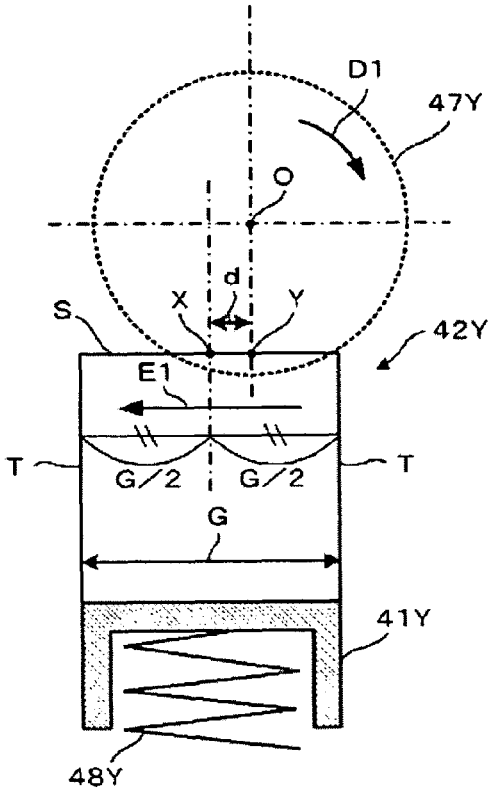
FIGS. 9A and 9B each are schematic front sectional view of another example of the unsuitable relative positional relation between the image bearing member-protecting agent and the rotation member.
Figure 9B:
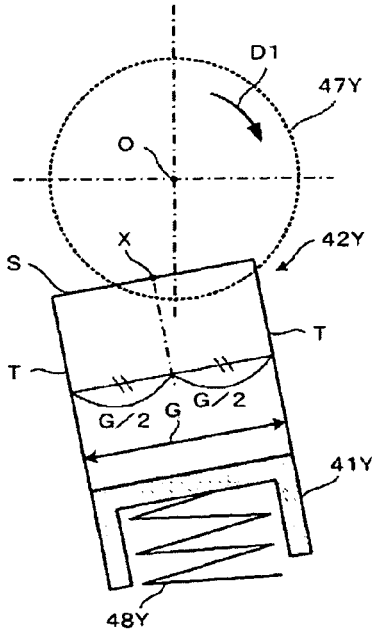

However, since the pressure is increased as described above, and the protecting agent 42Y is elastically supported by the spring 48Y, when the rotational force of the brush roller 47Y is applied to the protecting agent 42Y during the rotation of the brush roller 47Y, as shown in FIGS. 7B, 8B and 9B, a part of the protecting agent 42Y located downstream in the direction D1 downwardly inclines, and as shown in FIGS. 8B and 9B the brush roller 47Y may be brought into contact with the side surface T located upstream in the direction D1. Then, in the longitudinal direction, the contact pressure of the brush roller 47Y is nonuniformly applied to the protecting agent 42Y, and the protecting agent 42Y is not uniformly scraped off in the longitudinal direction. As a result, the frictional sliding surface of the protecting agent 42Y is nonuniformly consumed. Once the protecting agent 42Y is nonuniformly consumed, it is not recovered, but rather proceeds. The nonuniformly consumed part is consumed faster than the set service life. Thus, the service lives of the protecting film-forming device 40Y, and the process cartridge 68Y are shortened.

Therefore, in the protecting film-forming device 40Y, in the initial state that the brush roller 47Y does not rotate, the relative position of the protecting agent 42Y and the brush roller 47Y is adjusted and set not to the relative positions shown in FIGS. 8A and 9A, but to the relative position shown in FIG. 7A. FIGS. 8A to 9A each show a case that in the initial state that the brush roller 47Y does not rotate, the relative position of the protecting agent 42Y and the brush roller 47Y, is set in an unsuitable manner, which is different from the relative position in the protecting film-forming device 40Y to which the present invention is applied, as shown in FIG. 7A. FIGS. 7A to 9B are cross sectional diagram sectioned along a vertical plane in the longitudinal direction. The initial state means that the state that the protecting agent 42Y is not used, namely, the state that the protecting agent 42 is not scraped off by the brush roller 47Y at the time of shipment of the protecting film-forming device 40Y, the process cartridge 68Y, and the image forming apparatus 100, at the time of replacement of the process cartridge 68Y, and the like, or the state that the consumption of the protecting agent 42 is small after it is started to use, namely, the amount of the protecting agent 42 scraped off by the brush roller 47Y is small.

The relative position of the brush roller 47Y and the protecting agent 42Y in the initial state that the brush roller 47Y does not rotate in the protecting film-forming device 40Y shown in FIG. 7A will be described.

As shown in FIG. 7A, the surface to be scraped S has a width G in the transverse direction, i.e., lateral direction in FIG. 7A. The transverse direction is parallel to the direction E1 which is along the rotational direction D1 in the position where the brush roller 47Y faces the surface to be scraped S during the rotation of the brush roller 47Y.

X denotes a position which is a center of the width G in the direction E1 and located on the surface to be scraped S. The position X extends in the longitudinal direction. The position X is a center of the width in the transverse direction of the protecting agent 42Y, wherein the transverse direction is parallel to the direction E1.

Y denotes a position determined by extending a line from the rotational center O of the brush roller 47Y perpendicular to the surface to be scraped S and located on the surface to be scraped S. The position Y extends in the longitudinal direction. The position Y is a line of intersection between the surface to be scraped S and a line extended from the rotational center O perpendicular to the surface to be scraped S.

The relative position is formed in such a manner that the position X is located upstream in the direction E1 from the position Y. In other words, the position X is located upstream in the direction D1, and the distance d between the position X and the position Y is set to satisfy the relation represented by a formula $0<d\leq G/2$. The distance d is preferably set to satisfy the relation represented by a formula $0<d\leq G/6$, from the stand point of decrease in the degree of nonuniform consumption of the protecting agent 42Y. Such meaning of the relative position will be clarified by Examples and Comparative Examples described below.

By setting such relative position, as shown in FIG. 7B, during the rotation of the brush roller 47Y, the brush roller 47Y does not come into contact with the side surface T of the protecting agent 42Y, and the brush roller 47Y is in contact with the protecting agent 42Y in the longitudinal direction with uniform pressure. Thus, the protecting agent 42Y is uniformly scraped off in the longitudinal direction, and a frictional sliding surface, namely, the surface to be scraped S of the protecting agent 42Y is not nonuniformly consumed. Therefore, the protecting agent 42Y is consumed until the set service life ends, and the protecting film-forming device 40Y and the process cartridge 68Y are used until the set service lives end.

While the protecting agent 42Y decreases in the amount over time by being scraped off by the brush roller 47Y, the protecting agent 42Y is not nonuniformly consumed, since the protecting agent 42Y is uniformly pressed against the brush roller 47Y by the spring 48Y at a certain pressure in the longitudinal direction for a long period of time, and the relative position between the protecting agent 42Y and the brush roller 47Y is adjusted as described above. Thus, even when the protecting agent 42Y decreases to a small amount, a proper amount thereof is consistently held to the brush roller 47Y for a long period of time, and supplied to the photoconductor drum 20Y.

Therefore, the protecting agent 42Y suitably exhibits its function for a long period of time. That is, the coating film formed on the surface of the photoconductor drum 20Y using the protecting agent 42Y has a function of preventing the surface of the photoconductor drum 20Y from deterioration caused by proximity discharge, and the protecting film-forming device 40Y serves as a unit for protecting the photoconductor drum 20Y from deterioration caused by electric discharge. Here, deterioration means that both abrasion of the photoconductor drum 20Y by electric discharge and acceleration of the abrasion, and activation of the surface of the photoconductor drum 20Y.

Such coating film protects the deterioration, for example, abrasion caused by friction between the photoconductor drum 20Y and the cleaning blade 78Y, and filming on the surface of the photoconductor drum 20Y caused by the abrasion. Thus, the protecting film-forming device 40Y serves as a unit for protecting the photoconductor drum 20Y from deterioration caused by abrasion.

Moreover, since the protecting agent 42Y contains the fatty acid metal salt and the inorganic lubricant, the toner running through the cleaning blade is prevented or suppressed as described above. Thus, the abrasion of the photoconductor drum 20Y and the cleaning blade 78Y can be prevented or suppressed, and moreover the stain on the charging roller 91Y, and degradation of image quality can be prevented or suppressed.

Specifically, the photoconductor drum 20Y can continuously use for a long period of time without being replaced. Particularly, in the present embodiment, when the photoconductor drum 20Y contains at least a thermosetting resin in the outermost layer thereof, the protecting agent 42Y can protect the photoconductor drum 20Y from being deteriorated by electrical stress, to thereby provide the photoconductor drum 20Y containing the thermosetting resin with durability against mechanical stress applied thereon.

Since the charging roller 91Y is disposed in contact with or close to the surface of the photoconductor drum 20Y, a discharge region exists extremely close to the photoconductor drum 20Y, and the photoconductor drum 20Y is easily exposed to large electrical stress. However, the photoconductor drum 20Y is coated with the protecting agent 42Y, and can be used without being exposed to the electrical stress.

Also, since change in the state of the surface of the photoconductor drum 20Y can be minimized due to the protection of the protective layer of the protecting agent 42Y formed thereon, it is possible to perform stable cleaning for a long period of time even in the case of using toner having a large circularity or toner having a small average particle diameter, in which the quality of cleaning greatly varies depending upon change in the state of the surface of the photoconductor drum 20Y.

Owing to the protection of the protecting agent 42Y, water contact angle of the surface of the photoconductive drum 20Y is improved, and water repellency of the photoconductor drum 20Y is maintained. Thus, water absorption to the surface of the photoconductor drum 20Y is prevented or suppressed, to thereby prevent image blur.

Therefore, it is possible to greatly lengthen the period of time for which the process cartridge 68Y can be used without being replaced. Thus, the running cost is reduced and the amount of waste is greatly reduced.

When the protective agent 42Y does not substantially contain a metal component, the charging roller 91Y disposed in contact with or close to the photoconductor drum 20Y is not stained with a metal oxide or the like, thus the charging unit 90Y less changes over time.

Therefore, the members constituting the process cartridge 68Y, such as the photoconductor drum 20Y, the charging roller 91Y, or the like can easily reuse, and the amount of waste can be further reduced.

The protecting film-forming device 40Y can prevent or suppress the protecting agent 42Y from being nonuniformly consumed, and can use until the service life of the protecting agent 42Y ends, by setting the relative position of the brush roller 47Y and the protecting agent 42Y containing the fatty acid metal salt and the inorganic lubricant as described above in such a manner that the position X is located upstream in the direction E1 from the position Y, and that the distance d between position X and the position Y is in the range represented by the formula $0<d\leq G/2$. Thus, the protecting film-forming device 40Y and the process cartridge 68Y contribute to form excellent images for a long period of time, to thereby form excellent images for a long period of time using the image forming apparatus 100.

Other members of the protecting film-forming device 40Y will be described.

The material of the blade 45Y is not particularly limited. Examples of the material include elastic materials such as urethane rubber, hydrin rubber, silicone rubber and fluorine rubber, which are generally known as materials for cleaning blades. These elastic materials may be used individually or in a blended manner. Additionally, a portion of such a rubber blade which comes into contact with the photoconductor drum 20Y may be coated or impregnated with a low-friction-coefficient material. Further, in order to adjust the hardness of the elastic material used, a filling material such as an organic or inorganic filler may be dispersed therein.

Although the thickness of the blade 45Y cannot be unequivocally defined because the thickness is decided in view of the force applied by the spring 44Y, the blade preferably has a thickness of about 0.5 mm to about 5 mm, more preferably about 1 mm to about 3 mm.

Similarly, although the length of the blade 45Y which protrudes from the blade support 46Y and the flexure (so-called free length) of the blade cannot be unequivocally defined because the length is decided in view of the force applied by the spring 44Y, the length is preferably about 1 mm to about 15 mm, more preferably about 2 mm to about 10 mm.

Another structure of the coating blade 43Y may be employed in which a layer of a resin, rubber, elastomer, etc. is formed over a surface of an elastic metal blade such as a spring plate, using a coupling agent, a primer component, etc. if necessary, by a method such as coating or dipping, then subjected to thermal curing, etc. if necessary, and further, subjected to surface polishing, etc. if necessary.

In this case, the thickness of the elastic metal blade is preferably about 0.05 mm to about 3 mm, more preferably about 0.1 mm to about 1 mm.

In order to prevent the elastic metal blade from being twisted, the blade may be bent in a direction substantially parallel to the support shaft 49*a*Y after the installation of the blade.

As the material for the surface layer, a fluorine resin such as PFA, PTFE, FEP or PVdF, a fluorine-based rubber, a silicone-based elastomer such as methylphenyl silicone elastomer, or the like may be used with the addition of a filler if necessary. However, the material is not limited thereto.

The force with which the photoconductor drum 20Y is pressed by the blade 45Y may be the force with which the protecting agent 42Y is spread and formed into a protective layer or a protective film. The force is preferably 5 gf/cm to 80 gf/cm, more preferably 10 gf/cm to 60 gf/cm, as a linear pressure.

In order to reduce mechanical stress of the brush roller 47Y on the surface of the photoconductor drum 20Y, brush fibers of the brush roller preferably have flexibility.

As the material for the flexible brush fibers, one or more generally known materials may be used.

Specifically, resins having flexibility among the following materials may be used: polyolefin resins (e.g., polyethylene and polypropylene); polyvinyl resins and polyvinylidene resins (e.g., polystyrene, acrylic resins, polyacrylonitrile, polyvinyl acetate, polyvinyl alcohol, polyvinyl butyral, polyvinyl chloride, polyvinyl carbazole, polyvinyl ethers and polyvinyl ketones); vinyl chloride-vinyl acetate copolymers; styrene-acrylic acid copolymers; styrene-butadiene resins; fluorine resins (e.g., polytetrafluoroethylene, polyvinyl fluoride, polyvinylidene fluoride and polychlorotrifluoroethylene); polyesters; nylons; acrylics; rayon; polyurethanes; polycarbonates; phenol resins; amino resins (e.g. urea-formaldehyde resins, melamine resins, benzoguanamine resins, urea resins and polyamide resins); and so forth.

To adjust the extent to which the brush bends, diene-based rubber, styrene-butadiene rubber (SBR), ethylene propylene rubber, isoprene rubber, nitrile rubber, urethane rubber, silicone rubber, hydrin rubber, norbornene rubber and the like may be used in combination.

The support immobilizing the brush fibers at their bases is a rotatable roll-like support. To form the brush roller 47Y, the rotatable roll-like support is spirally wound by a tape with a pile of brush fibers around a metal core. Notably, this support may be a stationary support.

Each brush fiber preferably has a diameter of about 10 μm to about 500 μM and a length of 1 mm to 15 mm, and the number of the brush fibers is preferably 10,000 to 300,000 per square inch ($1.5\times10^7$ to $4.5\times10^8$ per square meter).

For the brush roller 47Y, use of a material having a high brush fiber density is highly desirable in terms of uniformity and stability of the supply; for example, it is desirable that one fiber be formed from several to several hundreds of fine fibers. More specifically, 50 fine fibers of 6.7 decitex (6 denier) may be bundled together and planted as one fiber, as exemplified by the case of 333 decitex=6.7 decitex×50 filaments (300 denier=6 denier×50 filaments).

Additionally, if necessary, the surface of the brush roller 47Y may be provided with a coating layer for the purpose of stabilizing the shape of the brush surface, the environment, etc. As component(s) of the coating layer, use of component(s) capable of deforming in a manner that conforms to the bending of the brush fibers is preferable, and the component(s) is/are not limited in any way as long as it/they can maintain its/their flexibility. Examples of the component(s) include polyolefin resins such as polyethylene, polypropylene, chlorinated polyethylene and chlorosulfonated polyethylene; polyvinyl resins and polyvinylidene resins, such as polystyrene, acrylics (e.g., polymethyl methacrylate), polyacrylonitrile, polyvinyl acetate, polyvinyl alcohol, polyvinyl butyral, polyvinyl chloride, polyvinyl carbazole, polyvinyl ethers and polyvinyl ketones; vinyl chloride-vinyl acetate copolymers; silicone resins including organosiloxane bonds, and modified products thereof (e.g., modified products made of alkyd resins, polyester resins, epoxy resins, polyurethanes, etc.); fluorine resins such as perfluoroalkyl ethers, polyfluorovinyl, polyfluorovinylidene and polychlorotrifluoroethylene;

polyamides; polyesters; polyurethanes; polycarbonates; amino resins such as urea-formaldehyde resins; epoxy resins; and combinations of these resins.

The structure of the photoconductor drum 20Y will be described in detail. Notably, this photoconductor drum has the same structure as the other photoconductor drums 20M, 20C and 20BK provided in the image forming units 60M, 60C and 60BK. Thus, the description of the other photoconductor drums 20M, 20C and 20BK is omitted.

The photoconductor drum 20Y includes a conductive substrate, and a photoconductive layer provided on the conductive substrate.

The structure of the photosensitive layer is selected from a single-layer structure in which a charge generating material and a charge transporting material are present in a mixed manner, a normal layer structure in which a charge transporting layer is provided on a charge generating layer, and an inverted layer structure in which a charge generating layer is provided on a charge transporting layer.

Additionally, a protecting layer may be provided on the photosensitive layer as the outermost surface, in order to improve the mechanical strength, abrasion resistance, gas resistance, cleaning ability, etc. of the photoconductor drum 20Y. Further, an underlying layer may be provided between the photoconductive layer and the conductive substrate. Also, if necessary, an appropriate amount of a plasticizer, an antioxidant, a leveling agent, etc. may be added to each layer.

The conductive substrate is not particularly limited as long as it exhibits a volume resistivity of $10^{10}$ Ω.cm or lower. For example, the substrate may be prepared by applying a metal such as aluminum, nickel, chromium, nichrome, copper, gold, silver, platinum or the like, or a metal oxide such as tin oxide or indium oxide or the like, for example, by vapor deposition or sputtering, onto film-form or cylindrical plastic or paper, or using a sheet of aluminum, aluminum alloy, nickel, or stainless steel or the like, and making it into a crude tube by extrusion or drawing or the like, and then surface-treating the tube by cutting, super-finishing, or grinding or the like.

The conductive substrate has a drum shape whose diameter is 20 mm to 150 mm, preferably 24 mm to 100 mm, more preferably 28 mm to 70 mm. When the drum-shaped conductive substrate has a diameter of 20 mm or less, it is physically difficult to place, around the photoconductor drum 20Y, members for the steps of charging, exposing, developing, transferring and cleaning. When the drum-shaped conductive substrate has a diameter of 150 mm or greater, it is undesirable because the image forming apparatus 100 is enlarged.

Particularly in the case where an image forming apparatus is of tandem type like the image forming apparatus 100 in the present embodiment, it is necessary to install a plurality of photoconductor drums therein, so that the diameter of the substrate of each photoconductor drum is preferably 70 mm or less, more preferably 60 mm or less. Moreover, the endless nickel belt and the endless stainless steel belt disclosed in JP-A No. 52-36016 can be used as the conductive substrate.

Examples of the underlying layer of the photoconductor drum include a layer composed mainly of a resin, a layer composed mainly of a white pigment and a resin, and an oxidized metal film obtained by chemically or electrochemically oxidizing the surface of a conductive substrate, with a layer composed mainly of a white pigment and a resin being preferred. Examples of the white pigment include metal oxides such as titanium oxide, aluminum oxide, zirconium oxide and zinc oxide. Among them, it is most preferable to use titanium oxide that is superior in preventing penetration of electric charge from the conductive substrate. Examples of the resin used for the underlying layer include thermoplastic resins such as polyamide, polyvinyl alcohol, casein and methyl cellulose, and thermosetting resins such as acrylics, phenol resins, melamine resins, alkyds, unsaturated polyesters and epoxies. These may be used alone or in combination.

Examples of the charge generating material include azo pigments such as monoazo pigments, bisazo pigments, trisazo pigments and tetrakisazo pigments; organic pigments and dyes such as triarylmethane dyes, thiazine dyes, oxazine dyes, xanthene dyes, cyanine pigments, styryl pigments, pyrylium dyes, quinacridone pigments, indigo pigments, perylene pigments, polycyclic quinone pigments, bisbenzimidazole pigments, indanthrone pigments, squarylium pigments and phthalocyanine pigments; and inorganic materials such as selenium, selenium-arsenic, selenium-tellurium, cadmium sulfide, zinc oxide, titanium oxide and amorphous silicon. These may be used alone or in combination. The underlying layer may have a single-layer structure or a multilayer structure.

Examples of the charge transporting material include anthracene derivatives, pyrene derivatives, carbazole derivatives, tetrazole derivatives, metallocene derivatives, phenothiazine derivatives, pyrazoline compounds, hydrazone compounds, styryl compounds, styryl hydrazone compounds, enamine compounds, butadiene compounds, distyryl compounds, oxazole compounds, oxadiazole compounds, thiazole compounds, imidazole compounds, triphenylamine derivatives, phenylenediamine derivatives, aminostilbene derivatives and triphenylmethane derivatives. These may be used alone or in combination.

Binder resin(s) used in forming the photoconductive layer composed of the charge generating layer and the charge transporting layer is/are electrically insulative and may be selected from known thermoplastic resins, thermosetting resins, photocurable resins, photoconductive resins and the like. Suitable examples thereof include, but not limited to, thermoplastic resins such as polyvinyl chloride, polyvinylidene chloride, vinyl chloride-vinyl acetate copolymers, vinyl chloride-vinyl acetate-maleic anhydride copolymers, ethylene-vinyl acetate copolymers, polyvinyl butyral, polyvinyl acetal, polyesters, phenoxy resins, (meth)acrylic resins, polystyrene, polycarbonates, polyarylate, polysulphone, polyethersulphone and ABS resins; thermosetting resins such as phenol resins, epoxy resins, urethane resins, melamine resins, isocyanate resins, alkyd resins, silicone resins and thermosetting acrylic resins; and photoconductive resins such as polyvinylcarbazole, polyvinylanthracene and polyvinylpyrene. These may be used alone or in combination.

Examples of the antioxidant include the following compounds.

Monophenolic Compounds 2,6-di-t-butyl-p-cresol, butylated hydroxyanisole, 2,6-di-t-butyl-4-ethylphenol, stearyl-β-(3,5-di-t-butyl-4-hydroxyphenyl)propionate, 3-t-butyl-4-hydroxyanisole and so forth.

Bisphenolic Compounds 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol) and so forth.

Polymeric Phenolic Compounds 1,1,3-tris-(2-methyl-4-hydroxy-5-t-butylphenyl)butane, 1,3,5-trimethyl-2,4,6-tris(3,5-di-t-butyl-4-hydroxybenzyl) benzene, tetrakis-[methylene-3-(3',5'-di-t-butyl-4'-hydroxyphenyl)propionate]methane, bis[3,3'-bis(4'-hydroxy-3'-t-butylphenyl)butylic acid]glycol ester, tocophenols and so forth.

p-Phenylenediamines

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine and so forth.

Hydroquinones 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone and so forth.

Organic Sulfur Compounds dilauryl-3,3'-thiodipropionate, distearyl-3,3'-thiodipropionate, ditetradecyl-3,3'-thiodipropionate and so forth.

Organic Phosphorus Compounds triphenylphosphine, tri(nonylphenyl)phosphine, tri(dinonylphenyl)phosphine, tricresylphosphine, tri(2,4-dibutylphenoxy)phosphine and so forth.

For the plasticizer, a resin such as dibutyl phthalate or dioctyl phthalate generally used as a plasticizer can be used as it is. It is appropriate that the amount of the plasticizer used be 0 parts by mass to 30 parts by mass, relative to 100 parts by mass of the binder resin.

A leveling agent may be added into the charge transporting layer. Examples of the leveling agent include silicone oils such as dimethyl silicone oil and methylphenyl silicone oil; and polymers or oligomers having perfluoroalkyl groups in their side chains. It is appropriate that the amount of the leveling agent used be 0 parts by mass to 1 part by mass relative to 100 parts by mass of the binder resin.

As described above, the surface layer is provided in order to improve the mechanical strength, abrasion resistance, gas resistance, cleaning ability, etc. of the photoconductor drum 20Y. Examples of the material for the surface layer include a polymer, and a polymer with an inorganic filler dispersed therein, both of which have greater mechanical strength than the photosensitive layer. The polymer used for the surface layer may be any polymer such as a thermoplastic polymer, and a thermosetting polymer, with a thermosetting polymer being preferred because it has high mechanical strength and is highly capable of reducing abrasion caused by friction with a cleaning blade. For this reason, the surface layer, namely the outermost surface of the photoconductor 20Y in this embodiment contains a thermosetting polymer. As long as the surface layer is thin, there may be no problem if it does not have charge transporting ability. However, when a surface layer having no charge transporting ability is formed so as to be thick, the photoconductor is easily caused to decrease in sensitivity, increase in electric potential after exposure, and increase in residual potential, so that it is desirable to mix the above-mentioned charge transporting material into the surface layer or use a polymer having charge transporting ability for the surface layer.

Generally, the photosensitive layer and the surface layer greatly differ from each other in mechanical strength, so that once the surface layer is abraded due to friction with the cleaning blade 78Y and thusly disappears, the photosensitive layer is also abraded. Therefore, when the surface layer is provided, it is important to make it have a sufficient thickness. The thickness of the surface layer is 0.1 μm to 12 μm, preferably 1 μm to 10 μm, more preferably 2 μm to 8 μm. When the thickness of the surface layer is less than 0.1 μm, it is not preferable because the surface layer is so thin that parts of the surface layer easily disappear due to friction with the cleaning blade 78Y, and abrasion of the photosensitive layer progresses through the missing parts. When the thickness of the surface layer is greater than 12 μm, it is not preferable because the photoconductor is easily caused to decrease in sensitivity, increase in electric potential after exposure, and increase in residual potential and, especially when a polymer having charge transporting ability is used, the cost of the polymer increases.

As the polymer used for the surface layer, a polymer which is transparent to writing light at the time of image formation and excellent in insulation, mechanical strength and adhesiveness is desirable. Examples thereof include resins such as ABS resins, ACS resins, olefin-vinyl monomer copolymers, chlorinated polyethers, allyl resins, phenol resins, polyacetals, polyamides, polyamide-imides, polyacrylates, polyallylsulfones, polybutylene, polybutylene terephthalate, polycarbonates, polyethersulfones, polyethylene, polyethylene terephthalate, polyimides, acrylic resins, polymethylpentene, polypropylene, polyphenylene oxide, polysulfones, polystyrene, AS resins, butadiene-styrene copolymers, polyurethanes, polyvinyl chloride, polyvinylidene chloride and epoxy resins. These polymers may be thermoplastic polymers. In order to improve the mechanical strength of the polymer, the polymer may be crosslinked with a crosslinking agent having a polyfunctional acryloyl group, carboxyl group, hydroxyl group or amino group to be a thermosetting polymer. Thus, the mechanical strength of the surface layer can be increased, and the amount of abrasion of the photoconductor surface due to friction with a cleaning blade can be significantly reduced.

As described above, the surface layer preferably has charge transporting ability. In order for the surface layer to have charge transporting ability, it is possible to employ a method in which a polymer used for the surface layer and the aforementioned charge transporting material are mixed together, or a method in which a polymer having charge transporting ability is used as the surface layer, with the latter method being preferable because a photoconductor which is highly sensitive and less increases in electric potential after exposure or in residual potential can be obtained.

Next, a toner suitably used for development in the image forming apparatus 100 will be specifically described.

The toner preferably has an average circularity of 0.93 to 1.00. A value obtained by Equation 1 is defined as a circularity, and the circularity indicates the degree of unevenness of a toner particle; when the toner particle is perfectly spherical, the circularity is 1.00; meanwhile, the more complex the surface shape of the toner particle becomes, the smaller the circularity becomes.

Circularity SR=Circumferential length of a circle having the same area as projected particle area/Circumferential length of projected particle image — Equation 1

When the average circularity is in the range of 0.93 to 1.00, the surface of toner particles is smooth, and the area where the toner particles are in contact with one another and the area where the toner particles are in contact with the photoconductor drum surface are small, so that excellent transferability can be obtained.

When the average circularity is closer to 1.00, the toner particles do not have angles. Thus, the torque with which a developer is stirred in a developing unit such as the developing device 80Y can be reduced and the driving for stirring can be stabilized. Therefore, abnormal images are not easily formed.

When the toner particles which form dots do not include angular toner particles in small amount, pressure is uniformly applied to the entire toner particles when they are transferred and pressed onto a transfer medium, and thus absence of toner particles hardly occurs during the transfer.

When the toner particles are not angular, the toner particles themselves have little abrasive power, thus not damaging or abrading the surface of the image bearing member.

Next, a method of measuring the average circularity will be described.

The average circularity can be measured using the flow-type particle image analyzer FPIA-1000 (produced by Toa Medical Electronics Co., Ltd.).

Specifically, in a container, 0.1 mL to 0.5 mL of a surfactant (preferably alkylbenzene sulfonate) is added as a dispersant into 100 mL to 150 mL of water, from which solid impurities have previously been removed. Then, approximately 0.1 g to 0.5 g of a measurement sample (toner) is added. The suspension in which the sample is dispersed is subjected to dispersing treatment by an ultrasonic dispersing device for approximately 1 min to 3 min, and the concentration of the dispersed solution is adjusted such that the number of particles of the sample is 3,000 per microliter to 10,000 per microliter. Under such conditions, the particle shape and particle size of the toner are measured using the analyzer.

In the present invention, the toner preferably has a mass average particle diameter D4 of 3 μm to 10 μm When the mass average particle diameter D4 is in this range, the toner includes particles which are sufficiently small in diameter with respect to fine dots of a latent image, thereby obtaining excellent dot reproducibility.

When the mass average particle diameter D4 is less than 3 μm, phenomena of decrease in transfer efficiency and blade cleaning ability easily arise.

When the mass average particle diameter D4 is greater than 10 μm, it is difficult to prevent ink-splattering in letters or characters and lines.

The ratio (D4/Dn) of the mass average particle diameter D4 of the toner to a number average particle diameter Dn of the toner is preferably in the range of 1.00 to 1.40. The closer the value of the ratio (D4/Dn) is to 1, the sharper the particle size distribution of the toner is.

Thus, when the ratio (D4/Dn) is in the range of 1.00 to 1.40, differences in particle diameter of the toner do not cause particles to be unevenly used for image formation, so that the image quality can be excellently stabilized.

Since the particle size distribution of the toner is sharp, the distribution of the frictional charge amount is also sharp, and thus the occurrence of fogging can be reduced.

When the toner has a uniform particle diameter, a latent image is developed such that particles are accurately and neatly arranged on dots of the latent image, and thus excellent dot reproducibility can be obtained.

Next, measurement method of the particle size distribution of toner particles will be explained.

Examples of a measuring device for particle size distribution of toner particles by the coulter counter method include COULTER COUNTER TA-II and COULTER MULTISIZER II (both of which are produced by Beckman Coulter, Inc.). The measurement method will be described below.

Firstly, 0.1 mL to 5 mL of a surfactant (preferably alkylbenzene sulfonate) is added as a dispersant into 100 mL to 150 mL of an electrolytic aqueous solution. Here, the electrolytic aqueous solution is an approximately 1% NaCl aqueous solution prepared using primary sodium chloride. For the preparation, ISOTON-II (produced by Beckman Coulter, Inc.) can be used, for example. Then, 2 mg to 20 mg of a measurement sample is added.

The electrolytic aqueous solution in which the sample is suspended is subjected to dispersing treatment by an ultrasonic dispersing device for approximately 1 min to 3 min, then the volume of the toner or toner particles and the number of the toner particles are measured by the measuring device, using apertures of 100 μm each, and the volume distribution and the number distribution are thus calculated. The mass average particle diameter D4 and the number average particle diameter Dn of the toner can be calculated from these distributions obtained.

As channels, the following 13 channels are used, and particles having diameters which are equal to or greater than 2.00 μm, and less than 40.30 μm are targeted: a channel of 2.00 μm or greater, and less than 2.52 μm; a channel of 2.52 μm or greater, and less than 3.17 μm; a channel of 3.17 μm or greater, and less than 4.00 μm; a channel of 4.00 μm or greater, and less than 5.04 μm; a channel of 5.04 μm or greater, and less than 6.35 μm; a channel of 6.35 μm or greater, and less than 8.00 μm; a channel of 8.00 μm or greater, and less than 10.08 μm; a channel of 10.08 μm or greater, and less than 12.70 μm; a channel of 12.70 μm or greater, and less than 16.00 μm; a channel of 16.00 μm or greater, and less than 20.20 μm; a channel of 20.20 μm or greater, and less than 25.40 μm; a channel of 25.40 μm or greater, and less than 32.00 μm; and a channel of 32.00 μm or greater, and less than 40.30 μm.

As such a substantially spherical toner, it is preferable to use a toner obtained by cross-linking and/or elongating a toner composition including a polyester prepolymer which has a nitrogen atom-containing functional group, a polyester, a colorant and a releasing agent in the presence of fine resin particles in an aqueous medium. The toner produced by the cross-linking and/or elongating reaction can reduce hot offset by hardening the toner surface and thus to prevent smears from being left on a fixing unit 6 and appearing on images.

Examples of prepolymers made from modified polyester resins, which are used for production of the toner, include isocyanate group-containing polyester prepolymers (A). Examples of compounds which elongate and/or cross-link with the prepolymers include amines (B).

Examples of the isocyanate group-containing polyester prepolymers (A) include a compound obtained by reaction between a polyisocyanate (3) and a polyester which is a polycondensate of a polyol (1) and a polycarboxylic acid (2) and contains an active hydrogen group. Examples of the active hydrogen group of the polyester include hydroxyl groups (for example, alcoholic hydroxyl groups and phenolic hydroxyl groups), amino groups, carboxyl groups and mercapto groups, with preference being given to alcoholic hydroxyl groups.

Examples of the polyol (1) include diols (1-1) and trihydric or higher polyols (1-2), and it is preferable to use any of the diols (1-1) alone, or mixtures each composed of any of the diols (1-1) and a small amount of any of the trihydric or higher polyols (1-2). Examples of the diols (1-1) include alkylene glycols (ethylene glycol, 1,2-propylene glycol, 1,3-propylene glycol, 1,4-butanediol, 1,6-hexanediol, etc.); alkylene ether glycols (diethylene glycol, triethylene glycol, dipropylene glycol, polyethylene glycol, polypropylene glycol, polytetramethylene ether glycol, etc.); alicyclic diols (1,4-cyclohexanedimethanol, hydrogenated bisphenol A, etc.); bisphenols (bisphenol A, bisphenol F, bisphenol S, etc.); alkylene oxide (ethylene oxide, propylene oxide, butylene oxide, etc.) adducts of the alicyclic diols; and alkylene oxide (ethylene oxide, propylene oxide, butylene oxide, etc.) adducts of the bisphenols. Of these, preference is given to alkylene glycols having 2 to 12 carbon atoms, and alkylene oxide adducts of bisphenols, and more preference is given to alkylene oxide adducts of bisphenols, and combinations of the alkylene oxide adducts of bisphenols and alkylene glycols having 2 to 12 carbon atoms. Examples of the trihydric or higher polyols (1-2) include trihydric to octahydric or higher aliphatic alcohols (glycerin, trimethylolethane, trimethylolpropane, pentaerythritol, sorbitol, etc.); trihydric or higher phenols (trisphenol PA, phenol novolac, cresol novolac, etc.); and alkylene oxide adducts of the trihydric or higher phenols.

Examples of the polycarboxylic acid (2) include dicarboxylic acids (2-1) and trivalent or higher polycarboxylic acids (2-2), and it is preferable to use any of the dicarboxylic acids (2-1) alone, or mixtures each composed of any of the dicarboxylic acids (2-1) and a small amount of any of the trivalent or higher polycarboxylic acids (2-2). Examples of the dicarboxylic acids (2-1) include alkylene dicarboxylic acids (succinic acid, adipic acid, sebacic acid, etc.); alkenylene dicarboxylic acids (maleic acid, fumaric acid, etc.); and aromatic dicarboxylic acids (phthalic acid, isophthalic acid, terephthalic acid, naphthalenedicarboxylic acid, etc.). Of these, preference is given to alkenylene dicarboxylic acids having 4 to 20 carbon atoms and aromatic dicarboxylic acids having 8 to 20 carbon atoms. Examples of the trivalent or higher polycarboxylic acids (2-2) include aromatic polycarboxylic acids (trimellitic acid, pyromellitic acid, etc.) having 9 to 20 carbon atoms. Additionally, the polycarboxylic acid (2) may be obtained by reaction between the polyol (1) and anhydrides or lower alkyl esters (methyl ester, ethyl ester, isopropyl ester, etc.) of the above-mentioned compounds.

As for the proportion of the polyol (1) to the polycarboxylic acid (2), the equivalence ratio [OH]/[COOH] of the hydroxyl group [OH] to the carboxyl group [COOH] is normally in the range of 2/1 to 1/1, preferably in the range of 1.5/1 to 1/1, more preferably in the range of 1.3/1 to 1.02/1.

Examples of the polyisocyanate (3) include aliphatic polyisocyanates (tetramethylene diisocyanate, hexamethylene diisocyanate, 2,6-diisocyanatomethyl caproate, etc.); alicyclic polyisocyanates (isophorone diisocyanate, cyclohexylmethane diisocyanate, etc.); aromatic diisocyanates (tolylene diisocyanate, diphenylmethane diisocyanate, etc.); aromatic aliphatic diisocyanates ($\alpha,\alpha,\alpha',\alpha'$-tetramethylxylylene diisocyanate, etc.); isocyanurates; and the polyisocyanates blocked with phenol derivatives, oximes, caprolactam, etc. These may be used alone or in combination.

As for the proportion of the polyisocyanate (3) to the polyester, the equivalence ratio [NCO]/[OH] of the isocyanate group [NCO] to the hydroxyl group [OH] of the hydroxyl group-containing polyester is normally in the range of 5/1 to 1/1, preferably in the range of 4/1 to 1.2/1, more preferably in the range of 2.5/1 to 1.5/1. When the equivalence ratio [NCO]/[OH] is greater than 5, there is a decrease in low-temperature fixing ability. When the isocyanate group [NCO] is less than 1 in molar ratio, the amount of urea contained in the modified polyester is small, adversely affecting resistance to hot offset. The amount of components of the polyisocyanate (3) contained in the isocyanate-group containing prepolymer (A) at its end is normally 0.5% by mass to 40% by mass, preferably 1% by mass to 30% by mass, more preferably 2% by mass to 20% by mass. When the amount is less than 0.5% by mass, there is a decrease in resistance to hot offset and there is a disadvantage in satisfying both heat-resistant storage ability and low-temperature fixing ability. When the amount is greater than 40% by mass, there is a decrease in low-temperature fixing ability.

The number of isocyanate groups contained per molecule in the isocyanate group-containing prepolymer (A) is preferably 1 or more, more preferably 1.5 to 3 on average, even more preferably 1.8 to 2.5 on average. When the number of the isocyanate groups per molecule is less than 1, the molecular mass of the urea-modified polyester is low, and thus there is a decrease in resistance to hot offset.

Examples of the amines (B) include diamines (B1), trivalent or higher polyamines (B2), amino alcohols (B3), amino mercaptans (B4), amino acids (B5), and compounds (B6) obtained by blocking amino groups of (B1) to (B5). Examples of the diamines (B1) include aromatic diamines such as phenylenediamine, diethyltoluenediamine, 4,4'-diaminodiphenylmethane, etc.; alicyclic diamines such as 4,4'-diamino-3,3'-dimethyldicyclohexylmethane, diaminecyclohexane, isophoronediamine, etc.; and aliphatic diamines such as ethylenediamine, tetramethylenediamine, hexamethylenediamine, etc. Examples of the trivalent or higher polyamines (B2) include diethylenetriamine and triethylenetetramine. Examples of the amino alcohols (B3) include ethanolamine and hydroxyethylaniline. Examples of the amino mercaptans (B4) include aminoethyl mercaptan and aminopropyl mercaptan. Examples of the amino acids (B5) include aminopropionic acid and aminocaproic acid. Examples of the compounds (B6) obtained by blocking amino groups of (B1) to (B5), include ketimine compounds which are prepared by reacting one of the amines (B1) to (B5) with a ketone (e.g. acetone, methyl ethyl ketone and methyl isobutyl ketone); and oxazoline compounds. Of these amines (B), preference is given to the diamines (B1), and mixtures each composed of any of the diamines (B1) and a small amount of any of the trivalent or higher polyamines (B2).

Further, an elongation terminator may be used so as to adjust the molecular mass of the urea-modified polyester, if necessary. Examples of the elongation terminator include monoamines such as diethylamine, dibutylamine, butylamine, laurylamine, etc., and compounds such as ketimine compounds obtained by blocking the monoamines.

As for the proportion of the amine (B), the equivalence ratio [NCO]/[NHx] of the isocyanate group [NCO] in the isocyanate group-containing prepolymer (A) to the amino group [NHx] in the amine (B) is normally in the range of 1/2 to 2/1, preferably in the range of 1.5/1 to 1/1.5, more preferably in the range of 1.2/1 to 1/1.2. When the equivalence ratio [NCO]/[NHx] is greater than 2 or less than 1/2, the molecular mass of the urea-modified polyester (i) is low, and thus there is a decrease in resistance to hot offset. The urea-modified polyester (i) may contain a urethane bond as well as a urea bond. The molar ratio of the amount of the urea bond to the amount of the urethane bond is normally in the range of 100/0 to 10/90, preferably in the range of 80/20 to 20/80, more preferably in the range of 60/40 to 30/70. When the urea bond is less than 10% in molar ratio, there is a decrease in resistance to hot offset.

By the above-mentioned reactions, a modified polyester, particularly the urea-modified polyester (i), used in the toner can be produced. The urea-modified polyester (i) is produced by a one-shot method or a prepolymer method. The mass average molecular mass of the urea-modified polyester (i) is normally 10,000 or greater, preferably 20,000 to 10,000,000, more preferably 30,000 to 1,000,000. When it is less than 10,000, there is a decrease in resistance to hot offset. The number average molecular mass of the urea-modified polyester (i) is not particularly limited when the below-mentioned unmodified polyester (ii) is used in combination, provided that the above-mentioned mass average molecular mass can be easily obtained. Namely, the mass average molecular mass of the urea-modified polyester (i) has priority over the number average molecular mass thereof when combined with the unmodified polyester (ii) described later. When the urea-modified polyester (i) is used alone, its number average molecular mass is normally 20,000 or less, preferably 1,000 to 10,000, more preferably 2,000 to 8,000. When it is greater than 20,000, the low-temperature fixing ability of the resultant toner degrades, and in addition the glossiness of full color images degrades.

Instead of using the urea-modified polyester (i) alone, an unmodified polyester (ii) may be additionally used as a binder resin component together with the urea-modified polyester (i). The use of the unmodified polyester (ii) together with the urea-modified polyester (i) is preferable to the use of the urea-modified polyester (i) alone because low-temperature fixing ability and glossiness of full color images of the resultant toner improve. Examples of the unmodified polyester (ii) include a polycondensate of a polyol (1) and a polycarboxylic acid (2) similar to the components of the urea-modified polyester (i), and suitable examples thereof are also the same as those suitable for the urea-modified polyester (i). The polyester (ii) does not necessarily have to be an unmodified polyester and may be a polyester modified with a chemical bond other than urea bond, for example urethane bond. It is desirable in terms of low-temperature fixing ability and resistance to hot offset that the urea-modified polyester (i) and the polyester (ii) be compatible with each other at least partially. Accordingly, it is desirable that the urea-modified polyester (i) and the polyester (ii) have similar compositions. When the polyester (ii) is used, the mass ratio of the urea-modified polyester (i) to the polyester (ii) is normally in the range of 5/95 to 80/20, preferably in the range of 5/95 to 30/70, more preferably in the range of 5/95 to 25/75, particularly preferably in the range of 7/93 to 20/80. When the mass ratio of the urea-modified polyester (i) is less than 5% by mass, there is a decrease in resistance to hot offset and there is a disadvantage in satisfying both the heat-resistant storage ability and the low-temperature fixing ability.

The peak molecular mass of the polyester (ii) is normally 1,000 to 30,000, preferably 1,500 to 10,000, more preferably 2,000 to 8,000. When it is less than 1,000, there is a decrease in heat-resistant storage ability. When it is greater than 10,000, there is a decrease in low-temperature fixing ability. The hydroxyl value of the polyester (ii) is preferably 5 or greater, more preferably 10 to 120, particularly preferably 20 to 80. When the hydroxyl value is less than 5, there is a disadvantage in satisfying both the heat-resistant storage ability and the low-temperature fixing ability. The acid value of the polyester (ii) is preferably 1 to 30, more preferably 5 to 20. With such an acid value, the polyester (ii) tends to be negatively charged.

The glass transition temperature (Tg) of the binder resin is normally 50° C. to 70° C., preferably 55° C. to 65° C. When it is lower than 50° C., toner blocking worsens when the toner is stored at a high temperature. When it is higher than 70° C., the low-temperature fixing ability is insufficient. Due to the presence of the urea-modified polyester together with the binder resin, the dry toner used in the present invention tends to be superior in heat-resistant storage ability to known polyester toners even if the toner has a low glass transition point. As for the storage elastic modulus of the binder resin, the temperature (TG') at which it is 10,000 dyne/cm$^2$, at a measurement frequency of 20 Hz, is normally 100° C. or higher, preferably 110° C. to 200° C. When the temperature (TG') is lower than 100° C., there is a decrease in resistance to hot offset. As for the viscosity of the binder resin, the temperature (Tη) at which it is 1,000 P, at a measurement frequency of 20 Hz, is normally 180° C. or lower, preferably 90° C. to 160° C. When the temperature is higher than 180° C., there is a decrease in low-temperature fixing ability. Accordingly, it is desirable that TG' be higher than Tη, in terms of satisfying both low-temperature fixing ability and resistance to hot offset. In other words, the difference between TG' and Tη (TG'-Tη) is preferably 0° C. or greater, more preferably 10° C. or greater, particularly preferably 20° C. or greater. The upper limit of the difference between TG' and Tη is not particularly limited. Also, it is desirable that the difference between Tη and Tg be preferably 0° C. to 100° C., more preferably 10° C. to 90° C., particularly preferably 20° C. to 80° C., in terms of satisfying both the heat-resistant storage ability and the low-temperature fixing ability.

The binder resin is produced by the following method or the like. Firstly, the polyol (1) and the polycarboxylic acid (2) are heated at a temperature of 150° C. to 280° C. in the presence of a known esterification catalyst such as tetrabutoxy titanate or dibutyltin oxide, then water produced is distilled away, with a reduction in pressure if necessary, and a hydroxyl group-containing polyester is thus obtained. Subsequently, the polyester is reacted with the polyisocyanate (3) at a temperature of 40° C. to 140° C. so as to obtain an isocyanate group-containing prepolymer (A). Further, the prepolymer (A) is reacted with an amine (B) at a temperature of 0° C. to 140° C. so as to obtain a urea-modified polyester. When the polyester is reacted with the polyisocyanate (3) and when the prepolymer (A) is reacted with the amine (B), a solvent may be used if necessary. Examples of usable solvents include aromatic solvents such as toluene, xylene, etc.; ketones such as acetone, methyl ethyl ketone, methyl isobutyl ketone, etc.; esters such as ethyl acetate, etc.; amides such as dimethylformamide, dimethylacetamide, etc.; and ethers such as tetrahydrofuran, etc., which are inactive to the polyisocyanate (3). In the case where the polyester (ii) which is not modified with a urea bond is additionally used, the polyester (ii) is produced in a manner similar to the production of the hydroxyl group-containing polyester, and the polyester (ii) is dissolved and mixed in a solution of the above-mentioned urea-modified polyester (i) in which reaction has been finished.

Generally, the toner used in the present invention can be produced by the following method. However, other methods may be employed instead.

The aqueous medium used in the present invention may consist of water alone or of water and a solvent miscible with water. Examples of the solvent miscible with water include alcohols such as methanol, isopropanol, ethylene glycol, etc.; dimethylformamide; tetrahydrofuran; cellusolves such as methyl cellusolve, etc.; and lower ketones such as acetone, methyl ethyl ketone, etc.

Toner particles may be formed in the aqueous medium by reaction between the amine (B) and a dispersion of the isocyanate group-containing prepolymer (A) or by using the urea-modified polyester (i) produced in advance. As a method for stably forming the dispersion of the prepolymer (A) and/or the urea-modified polyester (i) in an aqueous medium, there is, for example, a method of adding a toner material composition which includes the prepolymer (A) or the urea-modified polyester (i) into the aqueous medium and dispersing the composition by shearing force. The prepolymer (A) and other toner compositions (hereinafter referred to as "toner materials") such as a colorant, a colorant master batch, a releasing agent, a charge controlling agent and an unmodified polyester resin may be mixed together when the dispersion is formed in the aqueous medium; it is, however, more preferred that the toner materials be mixed together in advance, then the mixture is added and dispersed into the aqueous medium. Also the other toner materials such as the colorant, the releasing agent and the charge controlling agent do not necessarily have to be mixed when the particles are formed in the aqueous medium; the other toner materials may be added after the particles have been formed. For instance, particles which do not contain the colorant have been formed, and then the colorant may be added in accordance with a known dyeing method.

The dispersing method is not particularly limited, and known devices may be used in the method. Examples thereof include those using low-speed shearing dispersion, high-speed shearing dispersion, frictional dispersion, high-pressure jet dispersion and ultrasonic dispersion. The high-speed shearing dispersion is preferably used so as to form a dispersion having a particle diameter of 2 μm to 20 μm. In the case where a high-speed shearing dispersing machine is used, the rotational speed is not particularly limited, and it is normally 1,000 rpm to 30,000 rpm, preferably 5,000 rpm to 20,000 rpm. The length of time for which the dispersion lasts is not particularly limited, and it is normally 0.1 min to 5 min when a batch method is employed. The temperature for dispersion is normally 0° C. to 150° C. (under pressure), preferably 40° C. to 98° C. High temperatures are preferable in that the dispersion of the prepolymer (A) and/or the urea-modified polyester (i) has a low viscosity so as to be easily dispersed.

The amount of the aqueous medium used is normally 50 parts by mass to 2,000 parts by mass, preferably 100 parts by mass to 1,000 parts by mass, relative to 100 parts by mass of the toner composition which includes the prepolymer (A) and/or the urea-modified polyester (i). When the amount is less than 50 parts by mass, the toner composition is poorly dispersed, and thus toner particles having a predetermined diameter cannot be obtained. When the amount is greater than 2,000 parts by mass, it is not preferable from an economical point of view. Additionally, a dispersant may be used if necessary. Use of a dispersant is preferable in that the particle size distribution becomes sharper and that the dispersion is stabilized.

As to a process of synthesizing the urea-modified polyester (i) from the prepolymer (A), the amine (B) may be added so as to be reacted therewith, before the toner composition is dispersed in the aqueous medium; alternatively, the amine (B) may be added after the toner composition has been dispersed in the aqueous medium, allowing reaction to occur from particle interfaces. In this case, the urea-modified polyester may be preferentially formed on the surface of the toner produced, and a concentration gradient may be thus provided inside toner particles.

Examples of a dispersant for emulsifying or dispersing in a water-containing liquid an oily phase in which a toner composition is dispersed include anionic surfactants such as alkylbenzene sulfonates, α-olefin sulfonates and phosphoric acid esters; amine salt-based cationic surfactants such as alkylamine salts, aminoalcohol fatty acid derivatives, polyamine fatty acid derivatives and imidazoline; quaternary ammonium salt-based cationic surfactants such as alkyltrimethyl ammonium salts, dialkyl dimethyl ammonium salts, alkyl dimethyl benzyl ammonium salts, pyridinium salts, alkyl isoquinolinium salts and benzetonium chloride; nonionic surfactants such as fatty acid amide derivatives and polyhydric alcohol derivatives; and amphoteric surfactants such as alanine, dodecyldi(aminoethyl)glycine, di(octylaminoethyl)glycine and N-alkyl-N,N-dimethylammoniumbetaine.

Use of a fluoroalkyl group-containing surfactant makes it possible to produce its effects even when used in very small amounts. Suitable examples of fluoroalkyl group-containing anionic surfactants include fluoroalkyl carboxylic acids having 2 to 10 carbon atoms, and metal salts thereof, disodium perfluorooctanesulfonylglutamate, sodium 3-[ω-fluoroalkyl (C6 to C11) oxy]-1-alkyl (C3 to C4) sulfonate, sodium 3-[ω-fluoroalkanoyl (C6 to C8)-N-ethylamino]-1-propanesulfonate, fluoroalkyl (C11 to C20) carboxylic acids and metal salts thereof, perfluoroalkylcarboxylic acids (C7 to C13) and metal salts thereof, perfluoroalkyl (C4 to C12) sulfonic acids and metal salts thereof, perfluorooctanesulfonic acid diethanolamide, N-propyl-N-(2-hydroxyethyl)perfluorooctanesulfonamide, perfluoroalkyl (C6 to C10) sulfonamide propyltrimethylammonium salts, perfluoroalkyl (C6 to C10)-N-ethylsulfonylglycine salts and monoperfluoroalkyl (C6 to C16) ethyl phosphoric acid esters.

Examples of commercially available products of the fluoroalkyl group-containing surfactants include SURFLON S-111, S-112 and S-113 (produced by Asahi Glass Co., Ltd.); FLUORAD FC-93, FC-95, FC-98 and FC-129 (produced by Sumitomo 3M Limited); UNIDYNE DS-101 and DS-102 (produced by DAIKIN INDUSTRIES, LTD.); MEGAFACE F-110, F-120, F-113, F-191, F-812 and F-833 (produced by DIC Corporation); EFTOP EF-102, 103, 104, 105, 112, 123A, 123B, 306A, 501, 201 and 204 (produced by Tochem Products Co., Ltd.); and FTERGENT F-100 and F150 (produced by NEOS COMPANY LIMITED).

Examples of cationic surfactants include fluoroalkyl group-containing aliphatic primary, secondary or tertiary amine acids, aliphatic quaternary ammonium salts such as perfluoroalkyl (C6 to C10) sulfonamide propyltrimethylammonium salts, benzalkonium salts, benzetonium chloride, pyridinium salts and imidazolinium salts. Examples of cationic surfactants as products include SURFLON S-121 (produced by Asahi Glass Co., Ltd.), FLUORAD FC-135 (produced by Sumitomo 3M Limited), UNIDYNE DS-202 (produced by DAIKIN INDUSTRIES, LTD.), MEGAFACE F-150 and F-824 (produced by DIC Corporation), EFTOP EF-132 (produced by Tochem Products Co., Ltd.), and FTERGENT F-300 (produced by NEOS COMPANY LIMITED).

Also, as inorganic compound dispersants sparingly soluble in water, tricalcium phosphate, calcium carbonate, titanium oxide, colloidal silica, hydroxyappetite and the like may be used.

A polymeric protective colloid may be added to stabilize dispersion droplets. Examples thereof include acids such as acrylic acid, methacrylic acid, α-cyanoacrylic acid, α-cyanomethacrylic acid, itaconic acid, crotonic acid, fumaric acid, maleic acid and maleic anhydride; hydroxyl group-containing (meth)acrylic monomers such as acrylic acid β-hydroxyethyl, methacrylic acid β-hydroxyethyl, acrylic acid β-hydroxypropyl, methacrylic acid β-hydroxypropyl, acrylic acid γ-hydroxypropyl, methacrylic acid γ-hydroxypropyl, acrylic acid-3-chloro-2-hydroxypropyl, methacrylic acid-3-chloro-2-hydroxypropyl, diethyleneglycolmonoacrylic acid esters, diethyleneglycolmonomethacrylic acid esters, glycerinmonoacrylic acid esters, glycerinmonomethacrylic acid esters, N-methylolacrylamide and N-methylolmethacrylamide; vinyl alcohol and ethers of vinyl alcohol such as vinyl methyl ether, vinyl ethyl ether and vinyl propyl ether; esters of carboxyl group-containing compounds and vinyl alcohol such as vinyl acetate, vinyl propionate and vinyl butyrate; acrylamide, methacrylamide, diacetone acrylamide, and methylol compounds thereof, acid chlorides such as acrylic acid chloride and methacrylic acid chloride; homopolymers and copolymers of nitrogen-containing compounds such as vinyl pyridine, vinyl pyrolidone, vinyl imidazole and ethyleneimine, and of these nitrogen-containing compounds each having a heterocyclic ring; polyoxyethylene-based compounds such as polyoxyethylene, polyoxypropylene, polyoxyethylene alkylamine, polyoxypropylene alkylamine, polyoxyethylene alkylamide, polyoxypropylene alkylamide, polyoxyethylene nonyl phenyl ether, polyoxyethylene lauryl phenyl ether, polyoxyethylene stearyl phenyl ester and polyoxyethylene nonyl phenyl ester; and celluloses such as methyl cellulose, hydroxyethyl cellulose and hydroxypropyl cellulose.

In the case where a substance soluble in acid and/or alkali, such as a calcium phosphate salt, is used as a dispersion stabilizer, the calcium phosphate is dissolved in an acid, e.g. hydrochloric acid, then the calcium phosphate is removed from fine particles, for example by washing with water. Besides, its removal is enabled by a process such as decomposition brought about by an enzyme.

In the case where the dispersant is used, the dispersant may remain on the toner particle surface; it is, however, preferable in terms of toner charging ability to remove the dispersant by washing after elongation and/or cross-linking reaction.

Further, to reduce the viscosity of the toner composition, a solvent may be used in which the urea-modified polyester (i) and/or the prepolymer (A) are/is soluble. Use of the solvent is preferable in that the particle size distribution becomes sharper. The solvent is preferably volatile in terms of easy removal. Examples of the solvent include toluene, xylene, benzene, carbon tetrachloride, methylene chloride, 1,2-dichloroethane, 1,1,2-trichloroethane, trichloroethylene, chloroform, monochloro benzene, dichloroethylidene, methyl acetate, ethyl acetate, methyl ethyl ketone and methyl isobutyl ketone. These may be used alone or in combination. Of these, aromatic solvents such as toluene and xylene, and halogenated hydrocarbons such as methylene chloride, 1,2-dichloroethane, chloroform and carbon tetrachloride are preferable, aromatic solvents such as toluene and xylene are more preferable. The amount of the solvent used is normally 0 parts by mass to 300 parts by mass, preferably 0 parts by mass to 100 parts by mass, more preferably 25 parts by mass to 70 parts by mass, relative to 100 parts by mass of the prepolymer (A). In the case where the solvent is used, it is removed by heating under normal or reduced pressure after elongation and/or cross-linking reaction.

The length of time for which the elongation and/or the cross-linking reaction lasts is selected according to the reactivity between the isocyanate group structure of the prepolymer (A) and the amine (B) and is normally in the range of 10 min to 40 hr, preferably in the range of 2 hr to 24 hr. The reaction temperature is normally in the range of 0° C. to 150° C., preferably in the range of 40° C. to 98° C. Additionally, a known catalyst may be used if necessary. Specific examples thereof include dibutyltin laurate and dioctyltin laurate.

To remove an organic solvent from the obtained emulsified dispersion, a method can be employed in which the entire system is gradually increased in temperature and the organic solvent in droplets is completely removed by evaporation. Alternatively, by spraying the emulsified dispersion into a dry atmosphere and completely removing a water-insoluble organic solvent in droplets, fine toner particles can be formed, and also, an aqueous dispersant can be removed by evaporation. Generally, examples of the dry atmosphere into which the emulsified dispersion is sprayed include gases such as air, nitrogen, carbon dioxide gas and combustion gas which have been heated, especially flow of gasses heated to a temperature higher than or equal to the boiling point of the solvent used that has the highest boiling point. A dry atmosphere of highly desired quality can be obtained by a short-time process with a spray dryer, a belt dryer, a rotary kiln or the like.

In the case where the dispersion has a wide particle size distribution at the time of emulsification and dispersion, and washing and drying processes are carried out with the particle size distribution kept unchanged, it is possible to adjust the particle size distribution such that particles are classified according to a desired particle size distribution.

As to the classification, fine particles can be removed by a cyclone separator, a decanter, a centrifuge, etc. in liquid. The classification may be carried out after particles have been obtained as powder through drying; nevertheless, it is desirable in terms of efficiency that the classification be carried out in liquid. Unnecessary fine or coarse particles produced may be returned to a kneading process again so as to be used for formation of particles. In this case, the unnecessary fine or coarse particles may be in a wet state.

It is desirable that the dispersant used be removed from the obtained dispersion solution as much as possible and at the same time as the classification.

By mixing the obtained dried toner powder with different particles such as releasing agent fine particles, charge controlling fine particles, fluidizer fine particles and colorant fine particles and mechanically impacting the mixed powder, the different particles are fixed to and fused with the particle surface and thus it is possible to prevent detachment of the different particles from the surface of the composite particles obtained.

As specific method of performing the foregoing, there are a method of impacting the mixture, using a blade which rotates at high speed, and a method of pouring the mixture into a high-speed gas flow, accelerating the speed of the mixture and allowing particles to collide with one another or composite particles to collide with a certain plate. Examples of apparatuses for performing the foregoing include ANGMILL (produced by Hosokawa Micron Group); apparatuses in which the pulverization air pressure is reduced, made by modifying I-TYPE MILL (produced by Nippon Pneumatic Mfg. Co., Ltd.); HYBRIDIZATION SYSTEM (produced by NARA MACHINERY CO., LTD.); KRYPTRON SYSTEM (produced by Kawasaki Heavy Industries, Ltd.); and automatic mortars.

Examples of the colorant used for the toner include pigments and dyes conventionally used as colorants for toners. Specific examples thereof include carbon black, lamp black, iron black, ultramarine, nigrosine dyes, aniline blue, phthalocyanine blue, phthalocyanine green, Hansa Yellow G, Rhodamine 6C Lake, chalco oil blue, chrome yellow, quinacridone red, benzidine yellow and rose bengal. These may be used alone or in combination.

Further, if necessary, magnetic components may be included alone or in combination in toner particles in order for the toner particles themselves to have magnetic properties. Examples of the magnetic components include iron oxides such as ferrite, magnetite and maghemite, metals such as iron, cobalt and nickel, and alloys composed of these and other metals. Also, these components may be used as or used with colorant components.

Also, the number average particle diameter of the colorant in the toner used in the present invention is preferably 0.5 μm or less, more preferably 0.4 μm or less, even more preferably 0.3 μm or less.

When the number average particle diameter of the colorant in the toner is greater than 0.5 μm, the dispersibility of the pigment is insufficient, and thus favorable transparency cannot be obtained in some cases.

When the number average particle diameter of the colorant is less than 0.1 μm, i.e., a minute particle diameter, it is far smaller than the half wavelength of visible light; thus, it is thought that the colorant does not have an adverse effect on light-reflecting and absorbing properties. Therefore, the colorant particles having a number average particle diameter of less than 0.1 μm contribute to favorable color reproducibility and transparency of an OHP sheet with a fixed image. Meanwhile, when there are many colorant particles having a number average particle diameter of greater than 0.5 μm, transmission of incident light is disturbed and/or the incident light is scattered, and thus a projected image on an OHP sheet tends to decrease in brightness and saturation.

Moreover, the presence of many colorant particles which are greater than 0.5 μm in diameter is not preferable because the colorant particles easily detach from the toner particle surface, causing problems such as fogging, smearing of the drum and cleaning failure. It should be particularly noted that colorant particles having a number average particle diameter of greater than 0.7 μm preferably occupy 10% by number or less, more preferably 5% by number or less, of all colorant particles.

By kneading the colorant together with part or all of the binder resin in advance with the addition of a wetting liquid, the colorant and the binder resin are sufficiently attached to each other at an early stage, the colorant is effectively dispersed in toner particles in a subsequent toner production step, the dispersed particle diameter of the colorant becomes small, and thus more excellent transparency can be obtained.

For the binder resin kneaded together with the colorant in advance, any of the resins shown above as examples of the binder resins for the toner can be used without change, but the binder resin is not limited thereto.

As a specific method of kneading a mixture of the colorant and the binder resin in advance with the addition of the wetting liquid, there is, for example, a method in which the colorant, the binder resin and the wetting liquid are mixed together using a blender such as a HENSCHEL MIXER, then the obtained mixture is kneaded at a temperature lower than the melting temperature of the binder resin, using a kneading machine such as a two-roll machine or three-roll machine, and a sample is thus obtained.

For the wetting liquid, those commonly used may be used, in view of the solubility of the binder resin and the wettability thereof with the colorant; water and organic solvents such as acetone, toluene and butanone are preferable in terms of the colorant's dispersibility.

Of these, water is particularly preferably used in terms of the environment care and maintenance of the colorant's dispersion stability in the subsequent toner production step.

With the use of this production method, not only colorant particles contained in the obtained toner are small in diameter, but also the particles are in a highly uniformly dispersed state, so that the color reproducibility of an image projected by an OHP can be further improved.

Additionally, a releasing agent typified by wax may be contained along with the binder resin and the colorant in the toner.

The releasing agent is not particularly limited and may be appropriately selected from those known in the art depending on the intended purpose. Examples thereof include polyolefin waxes such as polyethylene wax, polypropylene wax, etc., long-chain hydrocarbons such as paraffin wax, Sasolwax, etc., and carbonyl group-containing waxes.

Of these, carbonyl group-containing waxes are preferable. Examples the carbonyl group-containing waxes include polyalkanoic acid esters such as carnauba wax, montan wax, trimethylolpropane tribehenate, pentaerythritol tetrabehenate, pentaerythritol diacetate dibehenate, glycerin tribehenate, 1,18-octadecanediol distearate, etc.; polyalkanol esters such as tristearyl trimellitate, distearyl maleate, etc; polyalkanoic acid amides such as ethylenediamine dibehenyl amide, etc.; polyalkylamides such as trimellitic acid tristearyl amide, etc.; and dialkyl ketones such as distearyl ketone, etc.

Of these carbonyl group-containing waxes, preference is given to polyalkanoic acid esters. The melting point of the releasing agent is usually 40° C. to 160° C., preferably 50° C. to 120° C., more preferably 60° C. to 90° C. Waxes having a melting point of lower than 40° C. adversely affect heat-resistant storage ability, and waxes having a melting point of higher than 160° C. are likely to cause cold offset when toner is fixed at a low temperature. The melt viscosity of the releasing agent is preferably 5 cps to 1,000 cps, more preferably 10 cps to 100 cps, when measured at a temperature higher than the melting point by 20° C. The releasing agent having a melt viscosity higher than 1,000 cps are not much effective in improving low-temperature fixing ability and resistance to hot offset. The amount of the releasing agent contained in the toner is preferably 0% by mass to 40% by mass, more preferably 3% by mass to 30% by mass.

Additionally, to adjust the charged amount of the toner and allow toner particles to rise quickly upon charging, a charge controlling agent may be contained in the toner if necessary. Here, when a colored material is used as the charge controlling agent, there is a change in color, so that use of a material which is colorless or whitish is preferable.

As the charge controlling agent is not particularly limited and may be appropriately selected from those known in the art depending on the intended purpose. Examples thereof include triphenylmethane dyes, molybdic acid chelate pigments, rhodamine dyes, alkoxy amines, quaternary ammonium salts (including fluorine-modified quaternary ammonium salts), alkylamides, phosphorus and compounds thereof, tungsten and compounds thereof, fluorine activators, metal salts of salicylic acid and metal salts of salicylic acid derivatives. Specific examples thereof include BONTRON P-51 as a quaternary ammonium salt, E-82 as an oxynaphthoic acid metal complex, E-84 as a salicylic acid metal complex, and E-89 as a phenolic condensate (produced by Orient Chemical Industries); TP-302 and TP-415 as quaternary ammonium salt molybdenum complexes (produced by Hodogaya Chemical Industries); COPY CHARGE PSY VP2038 as a quaternary ammonium salt, COPY BLUE PR as a triphenylmethane derivative, and COPY CHARGE NEG VP2036 and COPY CHARGE NX VP434 as quaternary ammonium salts (produced by Hoechst); LRA-901, and LR-147 as a boron complex (produced by Japan Carlit Co., Ltd.); quinacridone, azo pigments; and polymeric compounds containing functional groups such as sulfonic acid group, carboxyl group and quaternary ammonium salt.

The amount of the charge controlling agent used in the present invention is decided according to the type of the binder resin, the presence or absence of an additive used if necessary, and the toner production method including the dispersing method and so not unequivocally limited; however, the amount is in the range of 0.1 parts by mass to 10 parts by mass, preferably in the range of 0.2 parts by mass to 5 parts by mass, relative to 100 parts by mass of the binder resin. When the amount of the charge controlling agent is greater than 10 parts by mass, the charging ability of the toner is so great that effects of the charge controlling agent are reduced, and there is an increase in electrostatic suction toward a developing roller, causing a decrease in the fluidity of a developer and a decrease in image density. Such a charge controlling agent may be dissolved and dispersed in the toner after melted and kneaded together with a master batch and a resin, or may be directly added into an organic solvent when dissolved and dispersed therein, or may be fixed on the toner particle surface after the formation of toner particles.

When the toner composition is dispersed in the aqueous medium in the toner production step, fine resin particles mainly for stabilizing the dispersion may be added.

For the fine resin particles, any resin may be used as long as it can form an aqueous dispersion. The resin may be a thermoplastic resin or a thermosetting resin. Examples thereof include vinyl resins, polyurethane resins, epoxy resins, polyester resins, polyamide resins, polyimide resins, silicon resins, phenol resins, melamine resins, urea resins, aniline resins, ionomer resins and polycarbonate resins. These may be used alone or in combination. Of these resins, preference is given to vinyl resins, polyurethane resins, epoxy resins, polyester resins, and combinations thereof because an aqueous dispersion of fine spherical resin particles can be easily obtained.

As the vinyl resins, polymers each produced by homopolymerizing or copolymerizing a vinyl monomer are used. Examples thereof include, but not limited to, styrene-(meth) acrylate resins, styrene-butadiene copolymers, (meth)acrylic acid-acrylate copolymers, styrene-acrylonitrile copolymers, styrene-maleic anhydride copolymers and styrene-(meth) acrylate copolymers.

Further, fine inorganic particles are preferably used as an external additive to support the fluidity, developing ability and charging ability of toner particles.

The fine inorganic particles preferably have a primary particle diameter of 0.005 μm to 2 μm each, more preferably 0.005 μm to 0.5 μm each. Also, the fine inorganic particles preferably have a BET specific surface area of 20 $m^2/g$ to 500 $m^2/g$. The amount of the fine inorganic particles in the toner preferably occupies 0.01% by mass to 5% by mass, more preferably 0.01% by mass to 2.0% by mass. Specific examples of the fine inorganic particles include silica, alumina, titanium oxide, barium titanate, magnesium titanate, calcium titanate, strontium titanate, zinc oxide, tin oxide, silica sand, clay, mica, wollastonite, diatom earth, chrome oxide, cerium oxide, red ochre, antimony trioxide, magnesium oxide, zirconium oxide, barium sulfate, barium carbonate, calcium carbonate, silicon carbide and silicon nitride.

Moreover, examples thereof include fine polymer particles exemplified by polymer particles of thermosetting resins, polycondensates such as nylons, benzoguanamine and silicones, acrylic acid ester copolymers, methacrylic acid ester copolymers and polystyrene obtained by soap-free emulsion polymerization, suspension polymerization or dispersion polymerization.

With the use of the fluidizer, the toner particles can be surface treated so as to increase their hydrophobicity, thereby preventing a decrease in the fluidity and charging ability of the toner particles even at high humidity. Suitable examples of the fluidizer include silane coupling agents, silylating agents, fluorinated alkyl group-containing silane coupling agents, organic titanate coupling agents, aluminum coupling agents, silicone oils and modified silicone oils.

Examples of a cleaning improver for removing a developer which remains on the photoconductor drums 20Y, 20M, 20C, 20BK or the transfer belt 11, after image transfer, include the fatty acid metal salts such as zinc stearate, calcium stearate and stearic acid; and fine polymer particles produced by soap-free emulsion polymerization or the like, such as fine polymethyl methacrylate particles and fine polystyrene particles. The fine polymer particles have a relatively narrow particle size distribution, and those which are 0.01 μm to 1 μm in a volume average particle diameter are preferable.

By the use of such toner a high-quality toner image excellent in developing stability can be formed, as described above. However, toner particles remaining on the transfer belt 11, and the photoconductor drums 20Y, 20M, 20C, 20BK may possibly pass through a gap between the transfer belt 11, or the photoconductor drums 20Y, 20M, 20C, 20BK and a cleaning unit, such as the cleaning device 13, the cleaning device 70Y, etc. because the fineness and superior rotatability of the toner particles make it difficult for the cleaning unit to remove them. To remove the toner particles completely from the transfer belt 11, and the photoconductor drums 20Y, 20M, 20C, 20BK, it is necessary to press a toner removing member such as a cleaning blade 78Y against the transfer belt 11, and the photoconductor drums 20Y, 20M, 20C, 20BK with strong force. Such a load not only shortens the lifetimes of the transfer belt 11, the photoconductor drums 20Y, 20M, 20C, 20BK, the cleaning device 13Y, and the cleaning device 70Y, etc., but also contributes to consumption of extra energy.

In the case where the load on the transfer belt 11, and the photoconductor drums 20Y, 20M, 20C, 20BK is reduced, removal of the toner particles and carrier particles having a small diameter on the transfer belt 11, and the photoconductor drums 20Y, 20M, 20C, 20BK is insufficient, and these particles do damage to the surface thereof when passing through the cleaning device 13, and the cleaning device 70Y, etc., and thereby causing variation in the performance of the image forming apparatus 100.

As described above, since the image forming apparatus 100 has wide acceptable ranges with respect to the variation in the state of the surface of the photoconductor drums 20Y, 20M, 20C, 20BK, especially with respect to the existence of a low-resistance site, and has a structure in which the variation in charging performance to the photoconductor drums 20Y, 20M, 20C, 20BK is highly reduced. Therefore, the image forming apparatus and the above-mentioned toner are used together so as to obtain significantly high quality images in a stable manner for a long period of time.

Moreover, the image forming apparatus 100 can be used with a pulverized toner having an indefinite particle shape as well as with the above-mentioned toner suitable for obtaining high-quality images, and the lifetime of the apparatus can be greatly lengthened.

As the material for such a pulverized toner, any material normally used for toner can be used without any limitation in particular.

Examples of binder resins commonly used for the pulverized toner include, but not limited to, homopolymers of styrene and its substitution polymers, such as polystyrene, poly-p-chlorostyrene and polyvinyl toluene; styrene copolymers such as styrene-p-chlorostyrene copolymers, styrene-propylene copolymers, styrene-vinyl toluene copolymers, styrene-vinyl naphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers; styrene-ethyl methacrylate copolymers, styrene-butyl methacrylate copolymers, styrene-α-methyl chlormethacrylate copolymers, styrene-acrylonitrile copolymers, styrene-vinyl methyl ketone copolymers, styrene-butadiene copolymers, styrene-isoprene copolymers and styrene-maleic acid copolymers; homopolymers and copolymers of acrylic acid esters, such as polymethyl acrylate, polybutyl acrylate, polymethyl methacrylate and polybutyl methacrylate; polyvinyl derivatives such as polyvinyl chloride and polyvinyl acetate; polyester polymers, polyurethane polymers, polyamide polymers, polyimide polymers, polyol polymers, epoxy polymers, terpene polymers, aliphatic or alicyclic hydrocarbon resins and aromatic petroleum resins. These may be used alone or in combination. Of these, at least one selected from styrene-acrylic copolymer resins, polyester resins and polyol resins is more preferable in terms of electrical property, cost, and the like. The polyester resins and/or polyol resins are even more preferably used because of their excellent toner-fixing ability.

Additionally, for the above-mentioned reasons, resin component(s) contained in a coating layer of the charging member such as the charging roller 91Y, which is/are the same as the resin component(s) constituting the binder resin of the toner, is/are preferably at least one selected from linear polyester resin compositions, linear polyol resin compositions, linear styrene-acrylic resin compositions, and cross-linked products thereof.

As to the pulverized toner, for example, the resin component is mixed with the above-mentioned colorant component, wax component and charge controlling component in advance as necessary, then they are kneaded at a temperature lower than or equal to a temperature in the vicinity of the melting temperature of the resin component, and then the mixture is cooled and then subjected to a pulverization and classification step, thereby producing the toner; additionally, the above-mentioned externally added component may be suitably added and mixed therewith if necessary.

EXAMPLES

Hereinafter, the present invention will be specifically described by way of Examples along with Comparative Examples. However, it should be noted that the present invention is not construed to these Examples in any way.

<Usage Environment of Protecting Agent>

In the image forming part of IMAGIO MP C5000 (product of Ricoh Company, Ltd.), each of the protecting agents in Examples 1 to 7 and Comparative Examples 1 to 4 given below was supplied, instead of zinc stearate originally used in the apparatus, from a portion for the supply of zinc stearate. In the image forming part, the portion for the supply of zinc stearate was located, in a direction of movement of the photoconductor, upstream of the position where the toner image on the photoconductor was transferred onto a transfer belt but downstream of the position where the toner remaining on the photoconductor was removed therefrom with a cleaning device.

This IMAGIO MP C5000 (product of Ricoh Company, Ltd.) had such a configuration that the protecting agent was uniformly pressed at a constant pressure against a brush roller in the longitudinal direction thereof for a long period of time, as a press mechanism in which a protecting agent of zinc stearate originally provided in the apparatus was pressed against the brush roller. This configuration was the same as that of the image forming apparatus 100 as shown in FIG. 1 (see, for example, JP-A No. 2002-268397 regarding specific configuration).

<Usage Conditions of Protecting Agent>

Thirty thousand A4 size paper sheets each having an image occupation rate of 6% were printed out for the test.

The width G of the protecting agent was 12 mm. Thus, on the surface to be scraped S of the protecting agent, the distance from a side surface T to the position X (see FIG. 7A) was 12 mm/2=6 mm.

The distance d between the position X and the position Y as determined by using the formula $0<d\leq G/2$ was $0<d$ 6 mm.

Example 1

A protecting agent used was formed through compression molding of a mixture of a fatty acid metal salt and an inorganic lubricant in the ratio by mass of 8:2. The fatty acid metal salt was zinc stearate (product of NOF CORPORATION), and the inorganic lubricant was boron nitride (product of Momentive Performance Materials Inc.). As shown in FIG. 7A, the position X was located upstream in the direction E1 from the position Y, and the distance d was 1 mm.

Example 2

A protecting agent used was formed through compression molding of a mixture of a fatty acid metal salt and an inorganic lubricant in the ratio by mass of 8:2. The fatty acid metal salt was zinc stearate (product of NOF CORPORATION), and the inorganic lubricant was boron nitride (product of Momentive Performance Materials Inc.). As shown in FIG. 7A, the position X was located upstream in the direction E1 from the position Y, and the distance d was 2 mm.

Example 3

A protecting agent used was formed through compression molding of a mixture of a fatty acid metal salt and an inorganic lubricant in the ratio by mass of 8:2. The fatty acid metal salt was zinc stearate (product of NOF CORPORATION), and the inorganic lubricant was boron nitride (product of Momentive Performance Materials Inc.). As shown in FIG. 7A, the position X was located upstream in the direction E1 from the position Y, and the distance d was 4 mm.

Example 4

A protecting agent used was formed through compression molding of a mixture of a fatty acid metal salt and an inorganic lubricant in the ratio by mass of 8:2. The fatty acid metal salt was zinc stearate (product of NOF CORPORATION), and the inorganic lubricant was boron nitride (product of Momentive Performance Materials Inc.). As shown in FIG. 7A, the position X was located upstream in the direction E1 from the position Y, and the distance d was 6 mm.

Example 5

A protecting agent used was formed through compression molding of a mixture of a fatty acid metal salt and an inorganic lubricant in the ratio by mass of 8:2. The fatty acid metal salt was zinc stearate (product of NOF CORPORATION), and the inorganic lubricant was mica (product of Hayashi-Kasei Co., Ltd.). As shown in FIG. 7A, the position X was located upstream in the direction E1 from the position Y, and the distance d was 1 mm.

Example 6

A protecting agent used was formed through compression molding of a mixture of a fatty acid metal salt and an inorganic lubricant in the ratio by mass of 8:2. The fatty acid metal salt was magnesium stearate (product of Wako Pure Chemical Industries, Ltd.), and the inorganic lubricant was boron nitride (product of Momentive Performance Materials Inc.). As shown in FIG. 7A, the position X was located upstream in the direction E1 from the position Y, and the distance d was 1 mm.

Example 7

A protecting agent used was formed through compression molding of a mixture of a fatty acid metal salt and an inorganic lubricant in the ratio by mass of 8:2. The fatty acid metal salt was magnesium stearate (product of Wako Pure Chemical Industries, Ltd.), and the inorganic lubricant was mica (product of Hayashi-Kasei Co., Ltd.). As shown in FIG. 7A the position X was located upstream in the direction E1 from the position Y, and the distance d was 1 mm.

Comparative Example 1

A protecting agent used was formed through compression molding of a mixture of a fatty acid metal salt and an inorganic lubricant in the ratio by mass of 8:2. The fatty acid metal salt was zinc stearate (product of NOF CORPORATION), and the inorganic lubricant was boron nitride (product of Momentive Performance Materials Inc.). As shown in FIG. 8A the position X and the position Y were located at the same position in the direction E1.

Comparative Example 2

A protecting agent used was formed through compression molding of a mixture of a fatty acid metal salt and an inorganic lubricant in the ratio by mass of 8:2. The fatty acid metal salt was zinc stearate (product of NOF CORPORATION), and the inorganic lubricant was boron nitride (product of Momentive Performance Materials Inc.). As shown in FIG. 9A, the position X was located downstream of the direction E1 from the position Y, and the distance d was 1 mm.

Comparative Example 3

A protecting agent used was formed through compression molding of a mixture of a fatty acid metal salt and an inorganic lubricant in the ratio by mass of 8:2. The fatty acid metal salt was zinc stearate (product of NOF CORPORATION), and the inorganic lubricant was boron nitride (product of Momentive Performance Materials Inc.). As shown in FIG. 9A, the position X was located downstream of the direction E1 from the position Y, and the distance d was 2 mm.

Comparative Example 4

A protecting agent used was formed through compression molding of a fatty acid metal salt alone. The fatty acid metal salt was zinc stearate (product of NOF CORPORATION). As shown in FIG. 7A, the position X was located upstream in the direction E1 from the position Y, and the distance d was 1 mm.

In each of Examples and Comparative Examples, after the continuous paper feeding test, the degree of nonuniform consumption of the protecting agent, the degree of stain on the charging roller, and the degree of filming on the photoconductor were visually observed, and evaluated based on the following evaluation criteria. The results are shown in Tables 1-1 and 1-2.

<Evaluation Criteria of Nonuniform Consumption of Protecting Agent>

A: Nonuniform consumption of the protecting agent was hardly observed.

B: Nonuniform consumption of the protecting agent was observed, but allowable level.

C: Sever nonuniform consumption of the protecting agent was observed.

<Evaluation Criteria of Stain on Charging Roller>

A: Almost no stain on the charging roller was observed.

B: Stain was observed, but allowable level.

C: Severe stain was observed.

<Evaluation Criteria of Filming on Photoconductor>

A: Almost no filming on the photoconductor was observed.

B: Filming on the photoconductor was observed, but allowable level.

C: Severe filming on the photoconductor was observed.

TABLE 1-1

| | Conditions | |
|---|---|---|
| | The relation between the position X, which is a center of the width G in the direction E1 and located on the surface to be scraped S, and the position Y, which is a line of intersection between the surface to be scraped S and a line extended from the rotational center of the brush roller perpendicular to the surface to be scraped. | Protecting agent |
| Ex. 1 | The position X was located 1 mm upstream in the rotation direction of the brush roller from the position Y. | zinc stearate and boron nitride |
| Ex. 2 | The position X was located 2 mm upstream in the rotation direction of the brush roller from the position Y. | zinc stearate and boron nitride |
| Ex. 3 | The position X was located 4 mm upstream in the rotation direction of the brush roller from the position Y. | zinc stearate and boron nitride |
| Ex. 4 | The position X was located 6 mm upstream in the rotation direction of the brush roller from the position Y. | zinc stearate and boron nitride |
| Ex. 5 | The position X was located 1 mm upstream in the rotation direction of the brush roller from the position Y. | zinc stearate and mica |
| Ex. 6 | The position X was located 1 mm upstream in the rotation direction of the brush roller from the position Y. | magnesium stearate and boron nitride |
| Ex. 7 | The position X was located 1 mm upstream in the rotation direction of the brush roller from the position Y. | magnesium stearate and mica |
| Comp. Ex. 1 | The position X and the position Y were located at the same position in the rotation direction of the brush roller. (0 mm) | zinc stearate and boron nitride |
| Comp. Ex. 2 | The position X was located 1 mm downstream in the rotation direction of the brush roller from the position Y. | zinc stearate and boron nitride |
| Comp. Ex. 3 | The position X was located 2 mm downstream in the rotation direction of the brush roller from the position Y. | zinc stearate and boron nitride |
| Comp. Ex. 4 | The position X was located 1 mm upstream in the rotation direction of the brush roller from the position Y. | zinc stearate |

TABLE 1-2

| | Results | | |
|---|---|---|---|
| | Nonuniform consumption of protecting agent | Stain on charging roller | Filming on photoconductor |
| Ex. 1 | A | A | A |
| Ex. 2 | A | A | A |
| Ex. 3 | B | A | A |
| Ex. 4 | B | A | A |
| Ex. 5 | A | B | B |
| Ex. 6 | A | B | B |
| Ex. 7 | A | B | B |
| Comp. Ex. 1 | C | C | C |
| Comp. Ex. 2 | C | C | C |
| Comp. Ex. 3 | C | C | C |
| Comp. Ex. 4 | B | C | B |

From the comparison between Examples and Comparative Examples shown in Table 1, when the protecting agent contained the fatty acid metal salt and the inorganic lubricant, and was located in such a manner that, as shown in FIG. 7A, the position X was located upstream in the direction E1 from the position Y, and the distance d between the position X and the position Y and the width G of the protecting agent in the direction E1 satisfied the relation represented by the formula $0<d\leq G/2$, the degree of nonuniform consumption of the protecting agent, the degree of stain on the charging roller, and the degree of filming on the photoconductor were in the allowable range.

Moreover, as is understandable from the comparison between Example 1 and Examples 5 to 7, by using the combination of zinc stearate as the fatty acid metal salt and boron nitride as the inorganic lubricant for the protecting agent, the stain on the charging roller, and the filming on the photoconductor decreased, and the nonuniform consumption of the protecting agent, the stain on the charging roller, and the filming on the photoconductor hardly occurred.

From the comparison between Examples 1 and 2 and Examples 3 and 4, when the distance d was represented by the formula $0<d\leq G/6$, the nonuniform consumption of the protecting agent further decreased, and this was preferable.

Although preferred embodiments of the present invention are described above, the present invention is not limited to these specific embodiments. Unless specifically specified in the above description, the present invention can be variously altered or modified without departing from the scope defined by the appended claims.

For example, the rotation member is not limited to brush shape or roller shape, like the brush roller 47Y, and may be appropriately selected, as long as it is configured to be brought into contact with an image bearing member-protecting agent so as to scrape off and supply it to an image bearing member.

In one modification embodiment, the image bearing member may be an intermediate transfer medium like the transfer belt 11 in the above embodiment, although the image bearing member is a photoconductor in the embodiment described in Examples. In this case, the image bearing member-protecting agent of the present invention is applied to the intermediate transfer medium by the protecting agent-supplying device of the present invention, and a transfer medium corresponds to the recording paper in the above embodiment. The process cartridge of the present invention contains the intermediate transfer medium. A cleaning device for the intermediate transfer medium may be, for example, the cleaning device 13 described in the above embodiment. A charging unit for the intermediate transfer medium may be, for example, the primary transfer rollers 12Y, 12M, 12C and 12BK or the secondary transfer roller 5.

The process cartridge of the present invention includes at least, the image bearing member and the protecting agent-supplying device, the image bearing member and the protecting agent-supplying device being integrally provided, and may be detachably mounted on the main body of the image forming apparatus. Other constituent parts of the process cartridge are appropriately selected in consideration of service life, cost and mountability onto the process cartridge of the image bearing member and the other constituent parts.

The present invention can be applied to not only a so-called tandem image forming apparatus but also a so-called 1 drum-image forming apparatus in which toner images of colors are sequentially formed on one photoconductor drum and superimposed sequentially on top of the other to obtain a full color image. In addition, the present invention can be applied to not only color image forming apparatuses but also monochromatic image forming apparatuses. In any image forming apparatus, the toner images of colors may be directly transferred onto, for example, a transfer medium with no use of the intermediate transfer medium. In this configuration, the transfer belt 11 shown in, for example, FIG. 2 corresponds to the transfer medium.

The effects obtained by the above-described embodiments of the present invention are merely most preferable effects obtained in the present invention. The effects of the present invention should not be construed as being limited to those described in the embodiments of the present invention.

This application claims priority to Japanese patent application No. 2010-201140, filed on Sep. 8, 2010, and incorporated herein by reference.

What is claimed is:

1. A protecting agent-supplying device comprising:

a rotation member configured to rotate in a certain direction;

an image bearing member-protecting agent including a fatty acid metal salt and an inorganic lubricant, and being in the form of a solid, wherein a production apparatus for the image bearing member-protecting agent includes a lower mold, a pair of side molds, a pair of end molds, and an upper mold, wherein the side molds are disposed so as to sandwich the lower mold and form side surfaces of the image bearing member-protecting agent, and the end molds are disposed so as to sandwich the lower mold and the side molds and form end surfaces of the image bearing member-protecting agent, wherein the image bearing member-protecting agent is scraped off by the rotation of the rotation member in the certain direction, and supplied to an image bearing member, so as to protect the image bearing member, wherein the image bearing member-protecting agent is disposed to have a surface facing the rotation member, which surface has a width G in a direction along the certain direction, and wherein a center of the width G on the surface facing in the direction along the certain direction is defined as a position X, and a line of intersection between the surface facing the rotation member and a plane extended from the rotational center of the rotation member perpendicular to the surface facing the rotation member is defined as a position Y, and the position X is located upstream in the direction along the certain direction from the position Y, and a distance d between the position X and the position Y satisfies the relation represented by a formula $0<d\leq G/2$.

2. The protecting agent-supplying device according to claim 1, wherein the fatty acid metal salt is zinc stearate.

3. The protecting agent-supplying device according to claim 1, wherein the inorganic lubricant comprises at least one selected from the group consisting of boron nitride, mica, talc, kaoline, plate-shaped alumina, sericite, molybdenum disulfide, tungsten disulfide, montmorillonite, calcium fluoride, and graphite.

4. The protecting agent-supplying device according to claim 1, further comprises a layer-forming member configured to level the image bearing member-protecting agent supplied to the image bearing member to form a layer on the image bearing member.

5. The protecting agent-supplying device according to claim 1, wherein the lower mold forms a surface of the image bearing member-protecting agent at a side where the image bearing member-protecting agent is supported by a holder.

6. The protecting agent-supplying device according to claim 1, wherein the upper mold forms a surface of the image bearing member-protecting agent at a side of the rotation member.

7. The protecting agent-supplying device according to claim 1, wherein the pair of end molds, the lower mold, and the pair of side molds define a partially confined space.

8. The protecting agent-supplying device according to claim 7, wherein the upper mold enters a top of the partially confined space.

9. A process cartridge comprising:

a protecting agent-supplying device; and an image bearing member, to which an image bearing member-protecting agent is supplied by the protecting agent-supplying device, wherein the protecting agent-supplying device includes:

a rotation member configured to rotate in a certain direction;

the image bearing member-protecting agent including a fatty acid metal salt and an inorganic lubricant, and being in the form of a solid, wherein a production apparatus for the image bearing member-protecting agent includes a lower mold, a pair of side molds, a pair of end molds, and an upper mold, wherein the side molds are disposed so as to sandwich the lower mold and form side surfaces of the image bearing member-protecting agent, and the end molds are disposed so as to sandwich the lower mold and the side molds and form end surfaces of the image bearing member-protecting agent, wherein the image bearing member-protecting agent is scraped off by the rotation of the rotation member in the certain direction, and supplied to the image bearing member, so as to protect the image bearing member, wherein the image bearing member-protecting agent is disposed to have a surface facing the rotation member, which surface has a width G in a direction along the certain direction, and wherein a center of the width G on the surface facing in the direction along the certain direction is defined as a position X, and a line of intersection between the surface facing the rotation member and a plane extended from the rotational center of the rotation member perpendicular to the surface facing the rotation member is defined as a position Y, and the position X is located upstream in the direction along the certain direction from the position Y, and a distance d between the position X and the position Y satisfies the relation represented by a formula $0<d\leq G/2$.

10. An image forming apparatus comprising:

a protecting agent-supplying device;

an image bearing member, to which an image bearing member-protecting agent is supplied by the protecting agent-supplying device, wherein the protecting agent-supplying device includes:

a rotation member configured to rotate in a certain direction;

the image bearing member-protecting agent including a fatty acid metal salt and an inorganic lubricant, and being in the form of a solid, wherein a production apparatus for the image bearing member-protecting agent includes a lower mold, a pair of side molds, a pair of end molds, and an upper mold, wherein the side molds are disposed so as to sandwich the lower mold and form side surfaces of the image bearing member-protecting agent, and the end molds are disposed so as to sandwich the lower mold and the side molds and form end surfaces of the image bearing member-protecting agent, wherein the image bearing member-protecting agent is scraped off by the rotation of the rotation member in the certain direction, and supplied to the image bearing member, so as to protect the image bearing member, wherein the image bearing member-protecting agent is disposed to have a surface facing the rotation member, which surface has a width G in a direction along the certain direction, and wherein a center of the width G on the surface facing in the direction along the certain direction is defined as a position X, and a line of intersection between the surface facing the rotation member and a plane extended from the rotational center of the rotation member perpendicular to the surface facing the rotation member is defined as a position Y, and the position X is located upstream in the direction along the certain direction from the position Y, and a distance d between the position X and the position Y satisfies the relation represented by a formula $0<d\leq G/2$.

11. The image forming apparatus according to claim 10, further comprising a cleaning device configured to remove a toner remaining on the image bearing member therefrom, wherein the cleaning device is provided in contact with the image bearing member, and is located, in a moving direction of the image bearing member, downstream of a position where a toner image on the image bearing member is transferred onto a transfer medium and upstream of a position where the image bearing member-protecting agent is supplied to the image bearing member by the protecting agent-supplying device.

12. The image forming apparatus according to claim 10, wherein the image bearing member has a layer containing a thermosetting resin as the outermost surface thereof.

13. The image forming apparatus according to claim 10, wherein the image bearing member is a photoconductor.

14. The image forming apparatus according to claim 10, wherein the image bearing member is an intermediate transfer medium.

15. The image forming apparatus according to claim 10, further comprising a charging unit which is provided so as to face the image bearing member and configured to charge the image bearing member.

16. The image forming apparatus according to claim 15, wherein the charging unit comprises a voltage-applying unit configured to apply a voltage containing an alternating-current component.

17. The image forming apparatus according to claim 10, wherein a toner having an average circularity of 0.93 to 1.00 is used.

18. The image forming apparatus according to claim 10, wherein a toner having a ratio (D4/Dn) of a mass average particle diameter D4 to a number average particle diameter Dn of 1.00 to 1.40 is used.

* * * * *